US009996020B2

(12) United States Patent
Hayashida et al.

(10) Patent No.: US 9,996,020 B2
(45) Date of Patent: Jun. 12, 2018

(54) ROLLER, ROTATING MEMBER UNIT, CARTRIDGE, AND IMAGE FORMING APPARATUS

(71) Applicant: CANON KABUSHIKI KAISHA, Tokyo (JP)

(72) Inventors: Makoto Hayashida, Numazu (JP); Hiroomi Matsuzaki, Mishima (JP); Fumito Nonaka, Mishima (JP); Hiraku Sasaki, Susono (JP); Issei Imamura, Mishima (JP); Koji Yamaguchi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/623,861

(22) Filed: Jun. 15, 2017

(65) Prior Publication Data

US 2017/0371263 A1 Dec. 28, 2017

(30) Foreign Application Priority Data

Jun. 28, 2016 (JP) ..... 2016-127903
Jun. 28, 2016 (JP) ..... 2016-127959

(51) Int. Cl.
*G03G 15/00* (2006.01)
*G03G 15/02* (2006.01)
(Continued)

(52) U.S. Cl.
CPC ..... *G03G 15/0233* (2013.01); *G03G 15/0808* (2013.01); *G03G 15/1685* (2013.01); *G03G 15/2053* (2013.01); *G03G 15/751* (2013.01)

(58) Field of Classification Search
CPC ..... G03G 15/0233; G03G 15/0808; G03G 15/1685; G03G 15/2053; G03G 15/751;
(Continued)

(56) References Cited

U.S. PATENT DOCUMENTS 9,037,054 B2 * 5/2015 Mukai ..... G03G 15/2053 399/328
9,256,161 B2 2/2016 Hayashi et al.
(Continued)

FOREIGN PATENT DOCUMENTS

JP 2002-304103 A 10/2002
JP 2010-230748 A 10/2010
(Continued)

OTHER PUBLICATIONS

Copending, unpublished U.S. Appl. No. 15/630,031, dated Jun. 22, 2017.

*Primary Examiner* — Joseph S Wong
(74) *Attorney, Agent, or Firm* — Fitzpatrick, Cella, Harper & Scinto

(57) ABSTRACT

A cylindrical shaft of a roller has facing surfaces which form a depression-protrusion-shaped portion of a joint of the cylindrical shaft and which face or make contact with each other and moreover which extend in a direction non-parallel to an axial direction of the cylindrical shaft, and the facing surfaces are inclined at a predetermined engagement angle with respect to a circumferential direction. A generating line of a circumferential surface of a coating layer that coats an outer circumference of the cylindrical shaft and a generating line of a circumferential surface of a photosensitive drum cross each other at a crossing angle smaller than the engagement angle.

25 Claims, 19 Drawing Sheets

(51) Int. Cl.
*G03G 15/08* (2006.01)
*G03G 15/16* (2006.01)
*G03G 15/20* (2006.01)

(58) Field of Classification Search
CPC ..... G03G 15/0058; G03G 2215/025; G03G 2215/1614; G03G 2215/2058; G03G 2215/2067
See application file for complete search history.

(56) References Cited

U.S. PATENT DOCUMENTS

| | | | | |
|---|---|---|---|---|
| 9,423,715 | B2 | 8/2016 | Kamata et al. | |
| 9,500,977 | B2 | 11/2016 | Matsuzaki et al. | |
| 2015/0277266 | A1* | 10/2015 | Kamata ..... | G03G 15/0233 399/176 |
| 2016/0327901 | A1 | 11/2016 | Kamata et al. | |
| 2017/0219962 | A1 | 8/2017 | Sasaki et al. | |

FOREIGN PATENT DOCUMENTS

| | | | |
|---|---|---|---|
| JP | 2011-037539 | A | 2/2011 |
| JP | 2011-162314 | A | 8/2011 |
| JP | 2013-109209 | A | 6/2013 |
| JP | 2013-164456 | A | 8/2013 |
| JP | 2015-197507 | A | 11/2015 |

* cited by examiner

ROLLER, ROTATING MEMBER UNIT, CARTRIDGE, AND IMAGE FORMING APPARATUS

BACKGROUND OF THE INVENTION

Field of the Invention

The present invention relates to a roller provided in an electrophotographic image forming apparatus.

Description of the Related Art

Various rollers are provided in an electrophotographic image forming apparatus (hereinafter, an image forming apparatus) such as a copying machine, a printer (an LED printer, a laser beam printer, or the like), a facsimile apparatus, a word processor, or the like. For example, a conductive elastic roller (a charging roller) is used as a charging member in an image forming apparatus having a voltage application apparatus of a roller charging system. In the roller charging system, a conductive elastic roller is biased to make contact with a photosensitive member (an image bearing member) to apply a voltage to the photosensitive member so that the surface of the photosensitive member is charged. The charging roller typically has a configuration in which an entire longitudinal region other than both ends of a circumferential surface of a metal shaft is coated with an elastic layer (see paragraph [0022] and FIG. 2A of Japanese Patent Application Publication No. 2013-109209). Moreover, a charging roller in which a hollow metal shaft and a depression-protrusion joint are formed in a metal shaft of the charging roller, and a predetermined engagement angle is formed in a side surface in the longitudinal direction of the joint is also known (see paragraph [0091] and FIG. 21A of Japanese Patent Application Publication No. 2010-230748). Furthermore, a charging roller in which a predetermined crossing angle is formed in a photosensitive member in order to uniformize a contact pressure on the photosensitive member and realize positioning in the longitudinal direction is also known (see paragraph [0008] and FIG. 10 of Japanese Patent Application Publication No. 2002-304103). Moreover, a situation in which the rotation axes of contacting rotating members are not parallel to each other may also occur even when the members are not intentionally configured in the above-described manner. That is, since an image forming apparatus is generally configured such that a rotating member such as a charging roller receives rotation drive force at one end in the direction of the rotation axis, an inclination between both rotating members present when the members were assembled may increase further due to sliding resistance generated between the contacting rotating members.

SUMMARY OF THE INVENTION

However, when the crossing angle between the charging roller and the photosensitive member is larger than the engagement angle of the joint in the hollow metal shaft having the depression-protrusion joint formed therein, a state in which a load resulting from contact with the photosensitive member concentrates on one end side of a non-parallel portion of the joint may occur. When such a state occurs, the cylindricity and the total deflection (the degree of deflection of the entire roller circumferential surface when the charging roller is rotated) of the charging roller may deteriorate. A similar problem may occur even when a hollow metal shaft of the developing roller is coated with an elastic layer similarly to the charging roller (see Japanese Patent Application Publication No. 2013-164456).

An object of the present invention is to provide a roller capable of suppressing deterioration of cylindricity and a total deflection.

In order to attain the object, a roller of the present invention used in an image forming apparatus includes a cylindrical shaft having a joint that is formed by a pair of ends of the cylindrical shaft, the pair of ends face or make contact with each other in a circumferential direction; and a cylindrical coating layer that coats an outer circumference of the cylindrical shaft, the joint having a depression-protrusion-shaped portion, the joint being formed so as to extend from one end to the other end of the cylindrical shaft in an axial direction of the cylindrical shaft, and the roller making contact with a rotating member provided in an apparatus main body of the image forming apparatus or a cartridge that is detachable from the apparatus main body so that an axial line of the roller is not parallel to an axial line of the rotating member, wherein the cylindrical shaft has facing surfaces which form the depression-protrusion-shaped portion of the joint and which face or make contact with each other, and moreover which extend in a direction non-parallel to the axial direction, and the facing surfaces are inclined at a predetermined engagement angle with respect to a circumferential direction, and a generating line of a circumferential surface of the coating layer and a generating line of a circumferential surface of the rotating member cross each other at a crossing angle smaller than the engagement angle.

In order to attain the object, a rotating member unit of the present invention is used in an image forming apparatus and including a first rotating member and a second rotating member that rotate while making contact with each other, wherein the first rotating member includes a cylindrical shaft having a joint that is formed by a pair of ends of the cylindrical shaft, the pair of ends face or make contact with each other in a circumferential direction, the joint has a depression-protrusion-shaped portion and is formed so as to extend from one end to the other end of the cylindrical shaft in an axial direction of the cylindrical shaft, the first and second rotating members make contact with each other so that rotation axes thereof are not parallel to each other, the cylindrical shaft has facing surfaces which form the depression-protrusion-shaped portion of the joint and which face or make contact with each other and moreover which extend in a direction non-parallel to the axial direction, and the facing surfaces are inclined at a second angle with respect to the circumferential direction, the second angle being larger than a first angle which is an angle at which generating lines of circumferential surfaces of the first and second rotating members cross each other.

In order to attain the object, a cartridge of the present invention is configured to be detachable from an apparatus main body of an image forming apparatus, comprising the roller.

In order to attain the object, an image forming apparatus of the present invention includes the roller.

According to the present invention, it is possible to suppress deterioration of the cylindricity and total deflection.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

A roller to which the present invention is applicable is a conductive roller for applying voltage to a charging member such as, for example, an electrophotographic photosensitive member or a dielectric member. The conductive roller is provided in a voltage application apparatus, a developing apparatus, a developing cartridge, a process cartridge, and the like which are provided in an image forming apparatus. Another roller to which the present invention is applicable is a transport and discharge roller for transporting a recording medium (a recording material) which is an image forming target, for example.

Here, the voltage application apparatus is an apparatus which has a conductive roller and applies a voltage to a charging member such as an electrophotographic photosensitive member or a dielectric member with the aid of the conductive roller. The developing apparatus is an apparatus which has a developing roller and visualizes an electrostatic latent image (an electrostatic image) formed on an electrophotographic photosensitive member (a photosensitive drum) using a developer with the aid of the developing roller. The developing cartridge is a cartridge in which the developing apparatuses are integrated and which is detachably attached to an electrophotographic image forming apparatus main body. Moreover, the process cartridge is a cartridge in which a photosensitive drum and a developing apparatus that acts on the photosensitive drum are integrated and which is detachably attached to an image forming apparatus main body. Moreover, the image forming apparatus is an apparatus that forms an image on a recording material using an electrophotographic image forming method. Examples of the image forming apparatus include a copying machine, a printer (an LED printer, a laser beam printer, and the like), a facsimile apparatus, a word processor, and a combination thereof (a multi-function printer).

In the following description, the direction of a rotation axis of a photosensitive drum will be referred to as a longitudinal direction. Moreover, in the longitudinal direction, a side on which the photosensitive drum receives drive force from an image forming apparatus main body will be referred to as a driving side (the side close to a drive force receiving portion 63*a* in FIG. 6), and the opposite side will be referred to a non-driving side.

Figure 2:
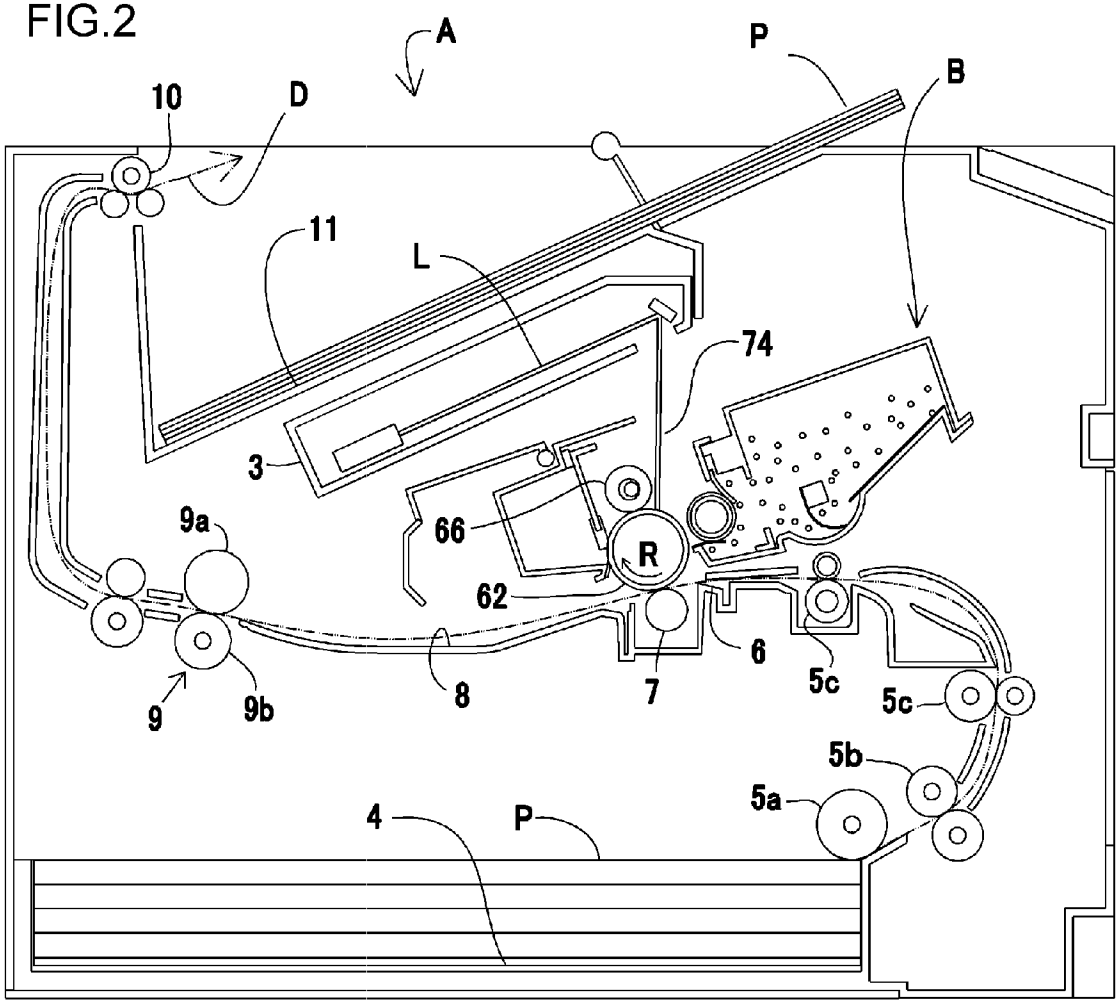
FIG. 2 is a cross-sectional view of an image forming apparatus.
Figure 3:
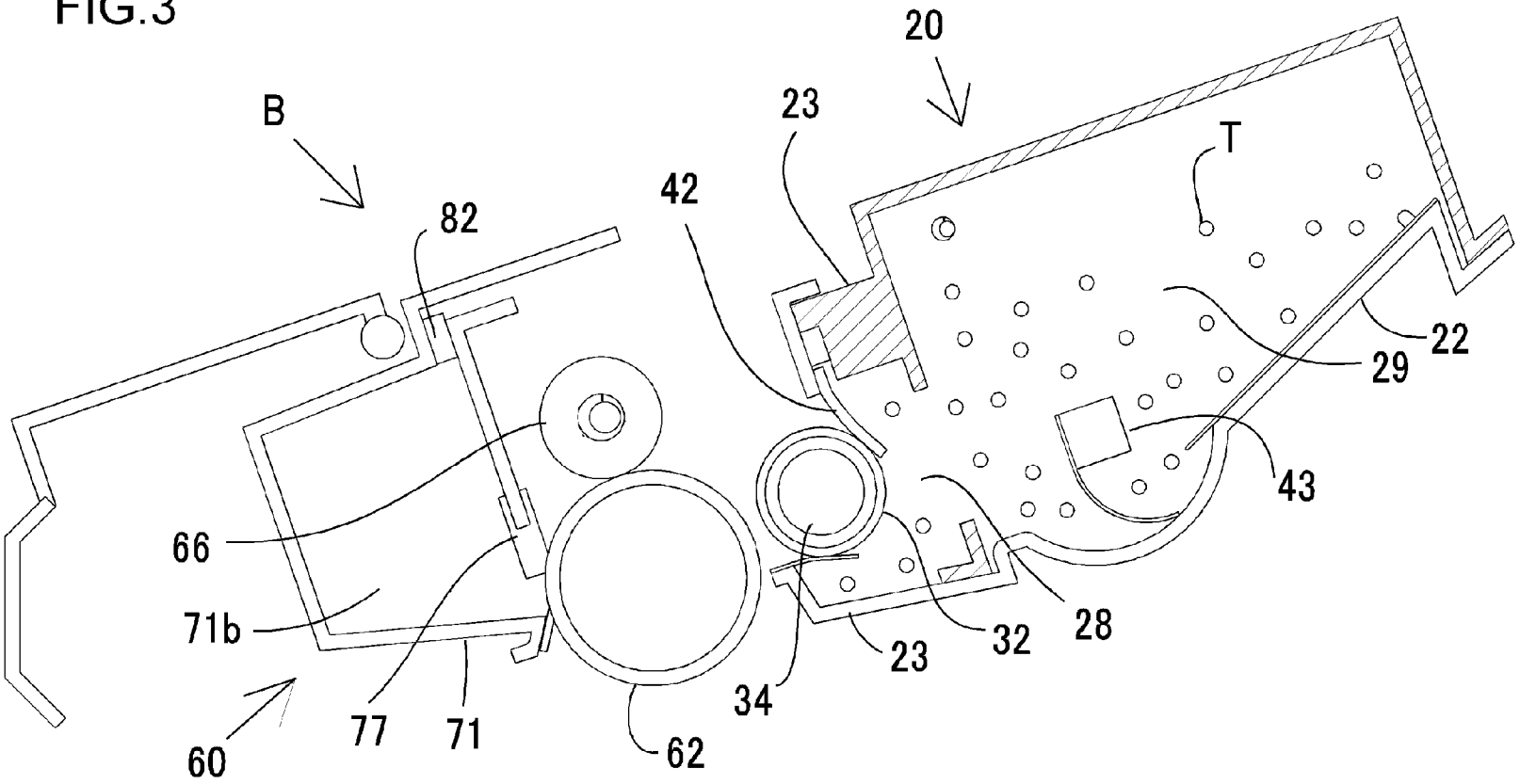
FIG. 3 is a cross-sectional view of a process cartridge.
Figure 4:
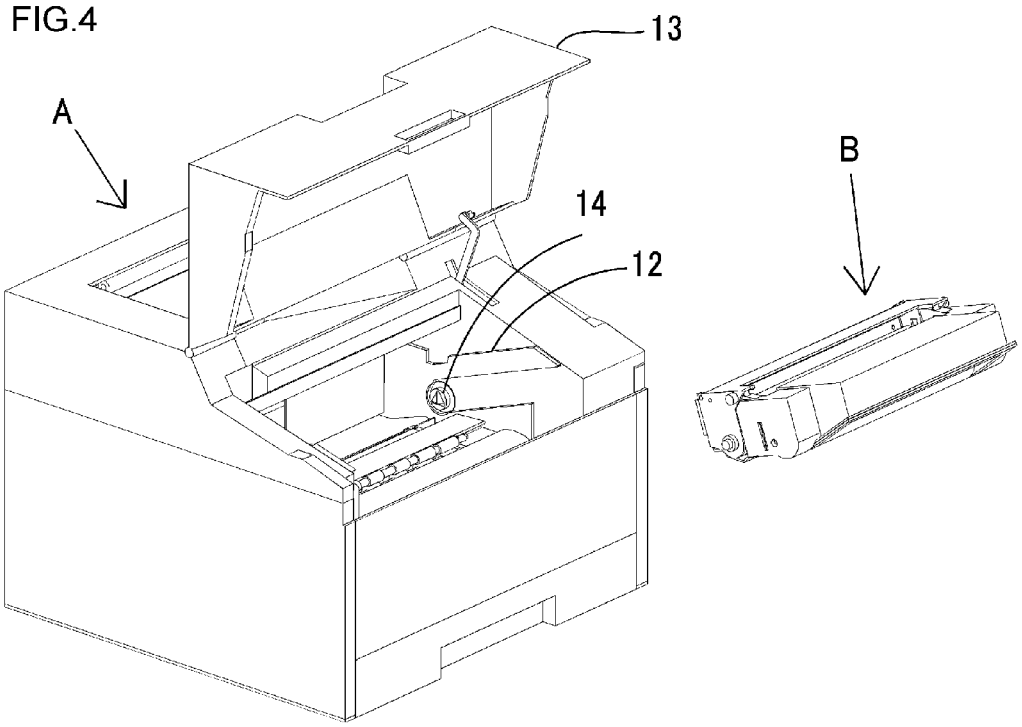
FIG. 4 is a perspective view of an image forming apparatus main body with a door open and a process cartridge.

An entire configuration and an image forming process of an image forming apparatus will be described with reference to FIGS. 2, 3, and 4. FIG. 2 is a schematic cross-sectional view of an image forming apparatus main body (hereinafter referred to as an apparatus main body A) and a process cartridge (hereinafter referred to as a cartridge B). FIG. 3 is a schematic cross-sectional view of the cartridge B. Here, the apparatus main body A of the image forming apparatus is an image forming apparatus portion excluding the cartridge B. FIG. 4 is a perspective view of the apparatus main body A and the process cartridge B.

(Entire Configuration of Image Forming Apparatus)

In FIGS. 2 and 4, the electrophotographic image forming apparatus is a laser beam printer which uses an electrophotographic technique and in which the cartridge B is detachably attached to the apparatus main body A. FIG. 4 is a perspective view illustrating how the cartridge B is attached to or detached from the apparatus main body A and illustrates a state in which a door 13 of the apparatus main body A is open in order to attach or detach the cartridge B. The door 13 is rotatably attached to the apparatus main body A. When the door 13 is open, a guide rail 12 is provided and the cartridge B can be attached to the apparatus main body A along the guide rail 12. A drive shaft 14 driven by a motor (not illustrated) of the apparatus main body A engages with the drive force receiving portion 63*a* (FIG. 6) provided in the cartridge B. Due to this, a drum 62 coupled to the drive force receiving portion 63*a* rotates upon receiving rotation drive force from the apparatus main body A. Furthermore, power is fed from a power feeding unit (not illustrated) of the apparatus main body A to the charging roller 66 and the developing roller 32.

An exposure apparatus 3 (a laser scanner unit) is disposed on the upper side of the cartridge B attached to the apparatus main body A. Moreover, a sheet tray 4 that stores a recording medium (hereinafter referred to as a sheet material P) serving as an image forming target is disposed on the lower side of the cartridge B. Furthermore, a pickup roller 5*a*, a feed roller pair 5*b*, a transport roller pair 5*c*, a transfer guide 6, a transfer roller 7, a transport guide 8, a fixing apparatus 9, a discharge roller pair 10, a discharge tray 11, and the like are sequentially disposed in the apparatus main body A along a transport direction D of the sheet material P. The fixing apparatus 9 includes a heating roller 9*a* and a pressure roller 9*b*.

(Image Forming Process)

Next, an overview of an image forming process will be described. An electrophotographic photosensitive drum (hereinafter referred to as a drum 62) is rotated at a predetermined peripheral velocity (a process speed) in the direction indicated by arrow R. A charging roller 66 to which a bias voltage is applied makes contact with an outer circumferential surface of the drum 62 to uniformly charge the outer circumferential surface of the drum 62. The exposure apparatus 3 outputs a laser beam L corresponding to image information. The laser beam L passes through an exposure window 74 in an upper surface of the cartridge B to scan and expose the outer circumferential surface of the drum 62. Due to this, an electrostatic latent image corresponding to the image information is formed on the outer circumferential surface of the drum 62.

On the other hand, as illustrated in FIG. 3, in a developing unit 20 as a developing apparatus, toner T in a toner supply chamber 29 is stirred and transported by rotation of a transport member 43 and is delivered to a toner supply chamber 28. The toner T is born on the surface of the developing roller 32 by magnetic force of a magnet roller 34 (a stationary magnet). The thickness of the toner T on the circumferential surface of the developing roller (a developing sleeve) 32 is regulated by a developing blade 42 while being triboelectrically charged. The toner T is transferred to the drum 62 according to the electrostatic latent image and is visualized as a toner image (a developer image).

As illustrated in FIG. 2, the sheet material P stored in the lower part of the apparatus main body A is fed from the sheet tray 4 by the pickup roller 5*a*, the feed roller pair 5*b*, and the transport roller pair 5*c* in synchronization with an output timing of the laser beam L. The sheet material P is supplied to a transfer position between the drum 62 and the transfer roller 7 via the transfer guide 6. At this transfer position, the toner image is transferred from the drum 62 to the sheet material P.

The sheet material P to which the toner image is transferred is separated from the drum 62 and is transported to the fixing apparatus 9 along the transport guide 8. The sheet material P passes through a nip between the heating roller 9*a* and the pressure roller 9*b* that form the fixing apparatus 9. A pressurizing, heating, and fixing process is performed in this nip, and the toner image is fixed to the sheet material P. The sheet material P having been subjected to the toner image fixing process is transported up to the discharge roller pair 10 and is discharged to the discharge tray 11.

On the other hand, as illustrated in FIG. 3, after the transfer process is performed, residual toner remaining on the outer circumferential surface of the drum 62 is removed by a cleaning blade 77 and is used again in an image forming process. The toner removed from the drum 62 is stored in a waste toner chamber 71*b* of the cleaning unit 60.

The charging roller 66, the developing roller 32, the transfer roller 7, the cleaning blade 77, and the like form a process unit that acts on the drum 62.

(Entire Configuration of Cartridge)

Figure 5:
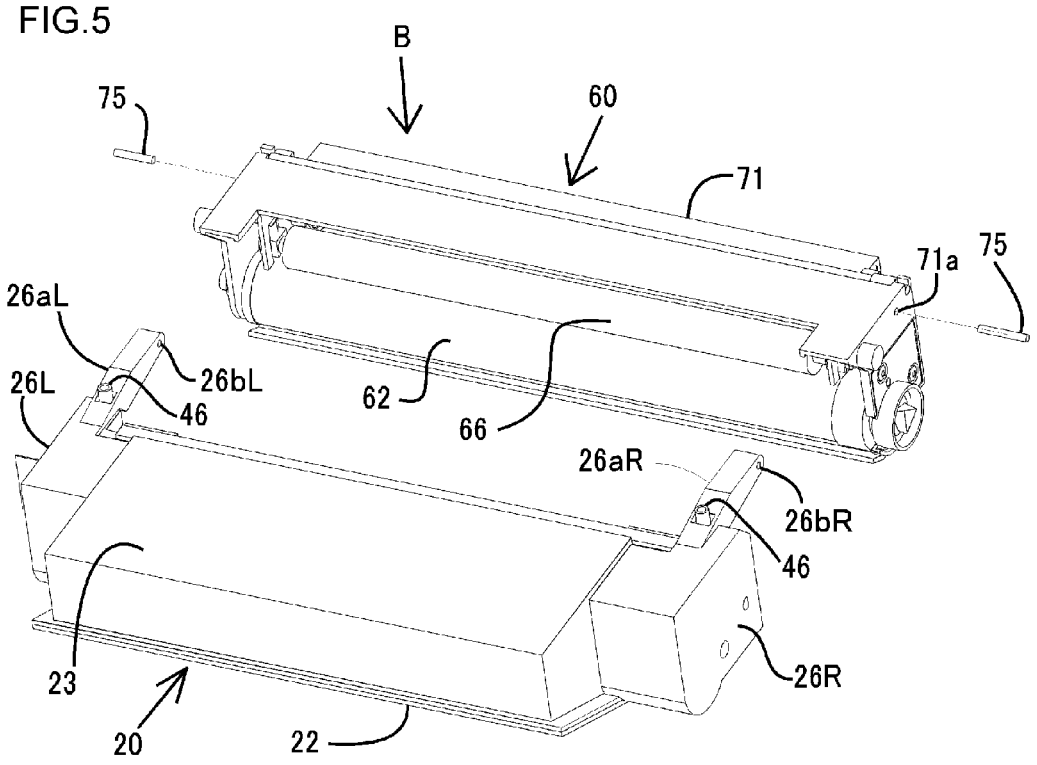
FIG. 5 is a perspective view for describing a configuration of the process cartridge.

An entire configuration of the cartridge B will be described with reference to FIGS. 3 and 5. FIG. 5 is an exploded perspective view for describing a configuration of the cartridge B. The cartridge B is formed by combining the cleaning unit 60 and the developing unit 20. The cleaning unit 60 includes a cleaning frame 71, the drum 62, the charging roller 66, the cleaning blade 77, and the like. On the other hand, the developing unit 20 includes a bottom member 22, a developing container 23, a first side member 26L, a second side member 26R, the developing blade 42, the developing roller 32, the magnet roller 34, the transport member 43, the toner T, a biasing member 46, and the like. Here, the direction of the rotation axis (the direction vertical to the sheet surface of FIG. 3) of the drum 62 or the developing roller 32 will be referred to as a longitudinal direction.

The cleaning unit 60 and the developing unit 20 are rotatably coupled by a coupling member 75 to form the cartridge B. Specifically, rotation holes 26*b*L and 26*b*R parallel to the developing roller 32 are formed at distal ends of arm portions 26*a*L and 26*a*R formed in the first and second side members 26L and 26R at both ends in the longitudinal direction (the axial direction of the developing roller 32) of the developing unit 20. Moreover, an insertion hole 71*a* for inserting the coupling member 75 is formed at both ends in the longitudinal direction of the cleaning frame 71. The coupling member 75 is inserted into the rotation holes 26*b*L and 26*b*R and the insertion hole 71*a* so that the arm portions 26*a*L and 26*a*R are aligned at predetermined positions of the cleaning frame 71. In this way, the cleaning unit 60 and the developing unit 20 are coupled so as to be able to rotate about the coupling member 75.

In this case, the biasing members 46 attached to the roots of the arm portions 26*a*L and 26*a*R come into contact with the cleaning frame 71 so that the developing unit 20 is biased to the cleaning unit 60 using the coupling member 75 as the center of rotation. In this way, the developing roller 32 is reliably pressed in the direction toward the drum 62. The developing roller 32 is held at a predetermined interval from the drum 62 by interval maintaining members (not illustrated) attached to both ends of the developing roller 32.

(Configuration of Cleaning Unit)

Figure 6:
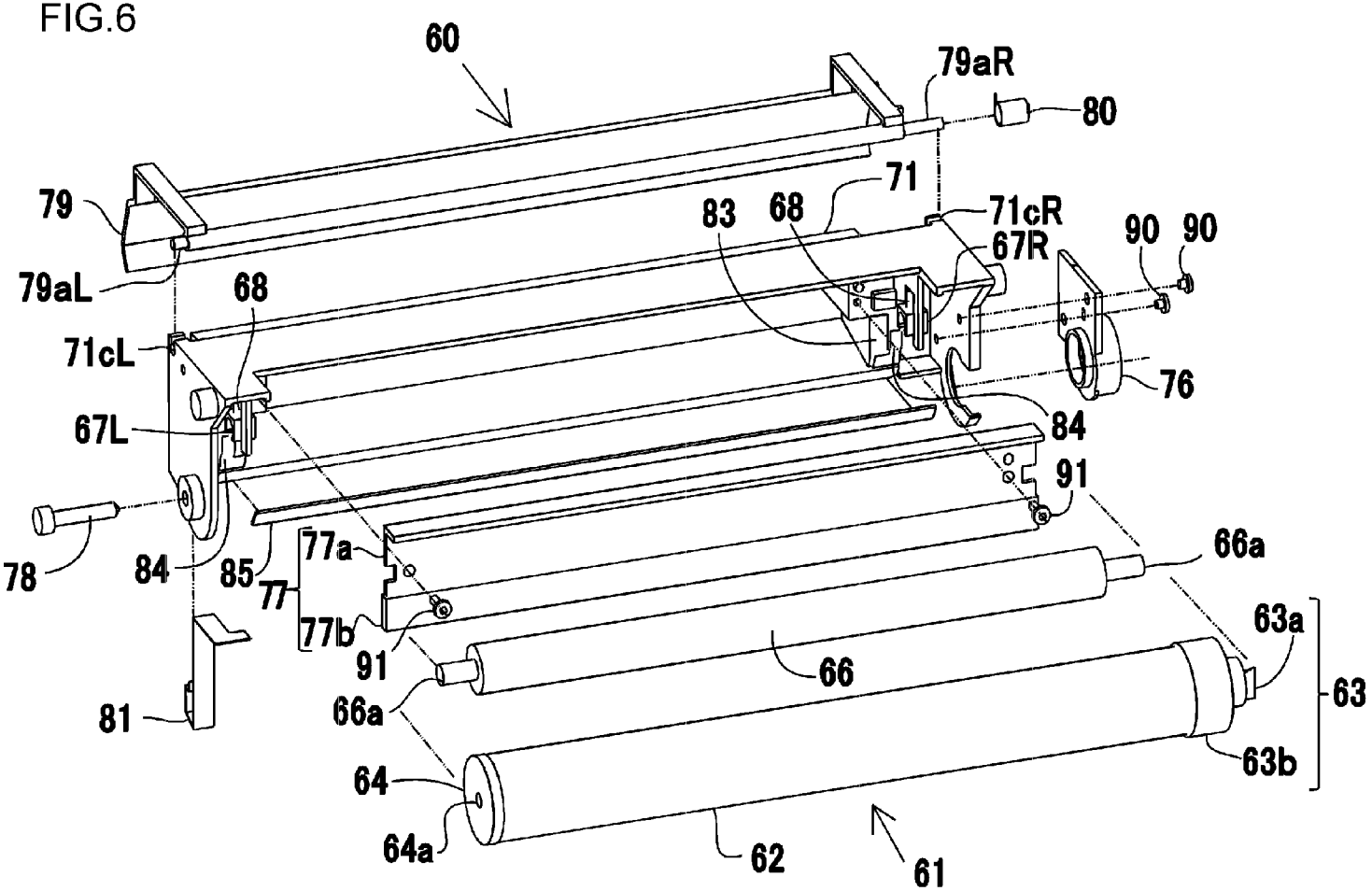
FIG. 6 is a perspective view for describing a configuration of a cleaning unit.
Figure 7A:
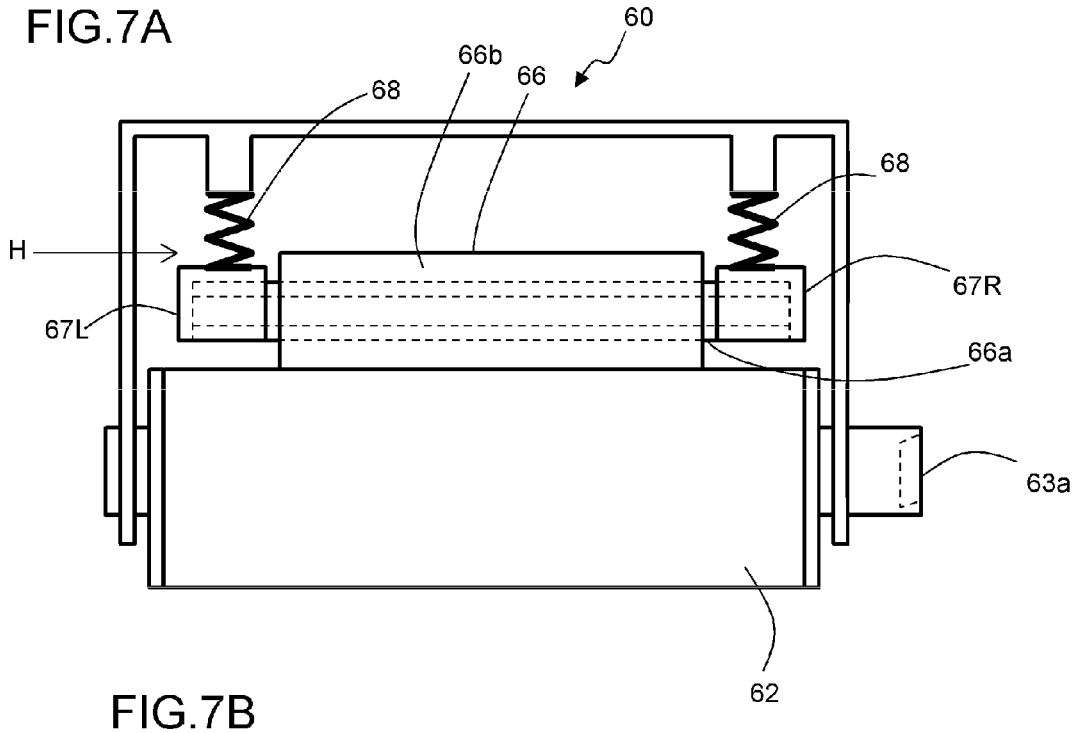
FIGS. 7A and 7B are diagrams for describing a configuration of the cleaning unit.
Figure 7B:
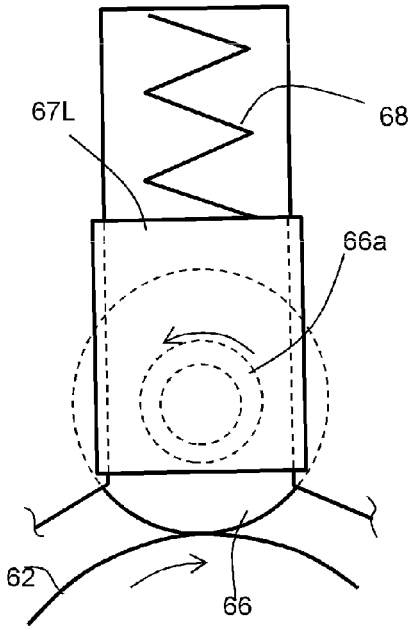

The configuration of the cleaning unit 60 will be described with reference to FIGS. 6, 7A, and 7B. FIG. 6 is a perspective view for describing a configuration of the cleaning unit 60. FIG. 7A is a front view for describing a configuration of the cleaning unit 60. FIG. 7B is a view taken along arrow H, of a supporting portion of the charging roller 66.

The cleaning blade 77 includes a supporting member 77*a* formed of a sheet metal and an elastic member 77*b* formed of an elastic material such as urethane rubber. Both ends of the supporting member 77*a* are fixed by screws 91 whereby the cleaning blade 77 is disposed at a predetermined position in relation to the cleaning frame 71. The elastic member 77*b* makes contact with the drum 62 and the residual toner is removed from the outer circumferential surface of the drum 62. The removed toner is stored in the waste toner chamber 71*b* (FIG. 3) of the cleaning unit 60.

A first sealing member 82 (FIG. 3), a second sealing member 83, a third sealing member 84, and a fourth sealing member 85 are fixed at a predetermined position of the cleaning frame 71 by a double-sided tape or the like. The first sealing member 82 (FIG. 3) is provided across the longitudinal direction so as to prevent waste toner from leaking from the rear side of the supporting member 77*a* of the cleaning blade 77. The second sealing member 83 prevents waste toner from leaking from both ends in the longitudinal direction of the elastic member 77*b* of the cleaning blade 77. The third sealing member 84 wipes out contaminants such as toner on the drum 62 while preventing waste toner from leaking from both ends in the longitudinal direction of the elastic member 77*b* of the cleaning blade 77. The fourth sealing member 85 is provided across the longitudinal direction in contact with the drum 62 so as to prevent waste toner from leaking from the upstream side in the rotation direction of the drum 62 in relation to the cleaning blade 77.

An electrode plate 81, a biasing member 68, and charging roller bearings 67L and 67R are attached to the cleaning frame 71. A metal shaft (hereinafter referred to as a shaft portion 66*a*) of the charging roller 66 is inserted into the charging roller bearings 67L and 67R. The charging roller 66 is biased toward the drum 62 by the biasing member 68 and is rotatably supported by the charging roller bearings 67L and 67R. The charging roller 66 rotates following the rotation of the drum 62.

The charging roller 66 is configured such that an entire region in the longitudinal direction of the outer circumferential surface of the hollow shaft portion 66*a* excluding both ends thereof is coated with a conductive elastic layer 66*b* as a coating layer of an elastic member. The elastic layer 66*b* and the shaft portion 66*a* are bonded by an adhesive. The shaft portion 66*a* is formed in a cylindrical form by press-processing a conductive sheet metal such as a stainless steel plate or a zinc-plated steel plate. Here, the hollow press-processed shaft portion 66*a* is used to reduce the weight and the cost of the cartridge and the image forming apparatus.

The electrode plate 81, the biasing member 68, the charging roller bearing 67L, and the shaft portion 66*a* have conductive properties. The electrode plate 81 is in contact with a power feeding unit (not illustrated) of the apparatus main body A. Power is fed to the charging roller 66 using these components as a power feeding path.

The drum 62 is integrally coupled to flanges 63 and 64 to form an electrophotographic photosensitive drum unit (hereinafter referred to as a drum unit 61). This coupling method uses caulking, adhesion, welding, and the like. A ground contact or the like (not illustrated) is coupled to the flange 64. Moreover, the flange 63 has the drive force receiving portion 63*a* that receives drive force from the apparatus main body A and a flange gear portion 63*b* that transmits drive force to the developing roller 32.

The bearing member 76 is integrally fixed to the driving side of the cleaning frame 71 by a screw 90, and a drum shaft 78 is fixed to the non-driving side of the cleaning frame 71 by press-fitting. The bearing member 76 engages with the shaft portion 63*b* of the flange 63 and the drum shaft 78 engages with a hole portion 64*a* of the flange 64. Due to this, the drum unit 61 is rotatably supported by the cleaning frame 71. The flange 64 is coupled to a ground portion (not illustrated) of the hole portion 64*a*.

A protection member 79 is rotatably supported by the cleaning frame 71 so that the drum 62 can be protected (shielded from light) and be exposed. The biasing member 80 is attached to a driving-side shaft portion 79*a*R of the protection member 79 so as to bias the protection member 79 in the direction of protecting the drum 62. A non-driving-side shaft portion 79*a*L and the driving-side shaft portion 79*a*R of the protection member 79 are fitted to bearing portions 71*c*L and 71*c*R of the cleaning frame 71.

(Configuration of Charging Roller)

Figure 1A:
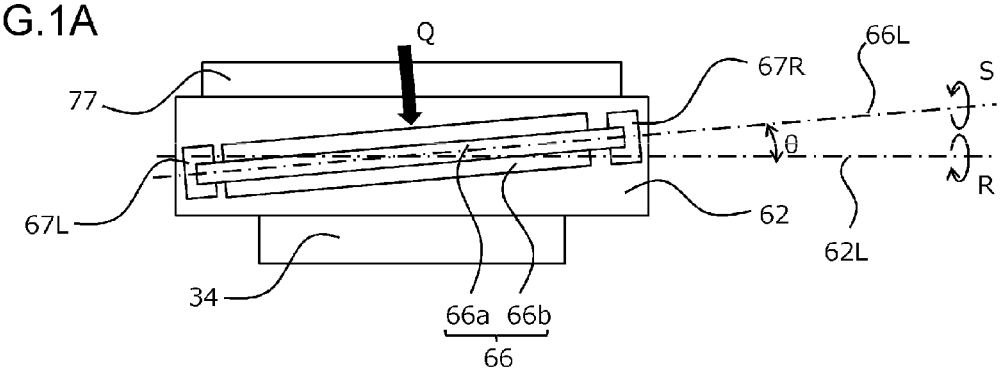
FIGS. 1A to 1C are explanatory diagrams illustrating a configuration of a roller (a charging roller) according to Embodiment 1 of the present invention.
Figure 1B:
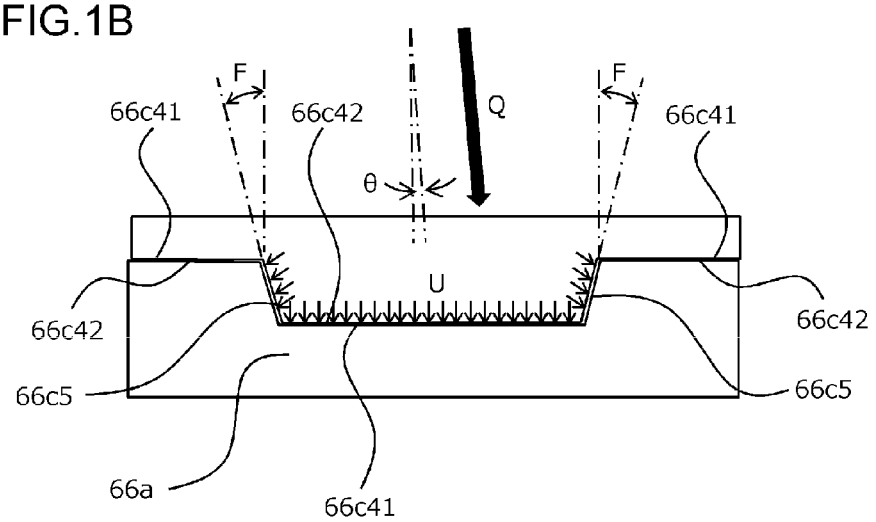
Figure 1C:
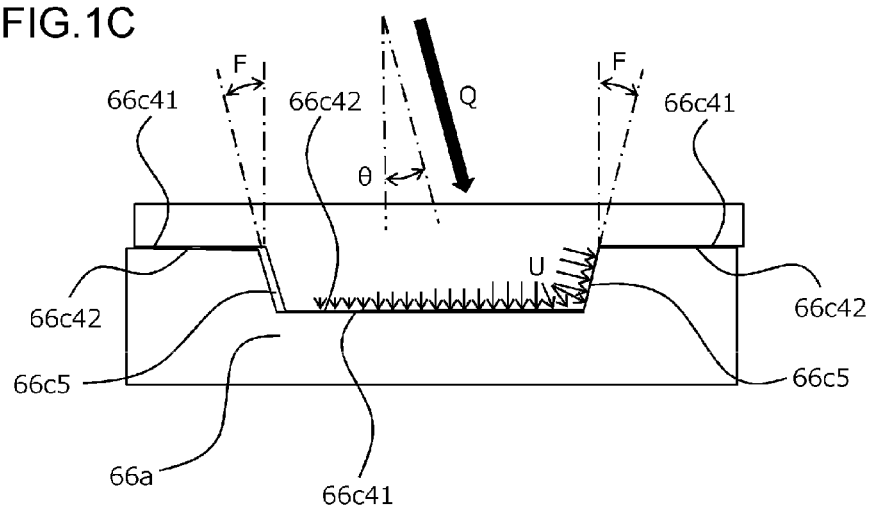
Figure 8:
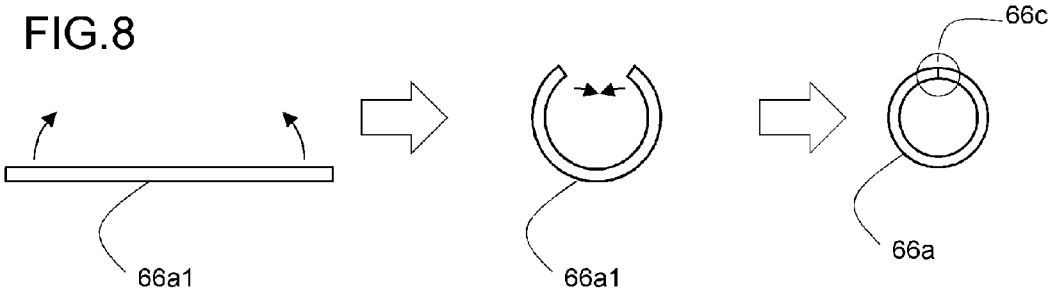
FIG. 8 is an explanatory diagram of a step of processing the roller according to Embodiment 1 of the present invention.
Figure 9:
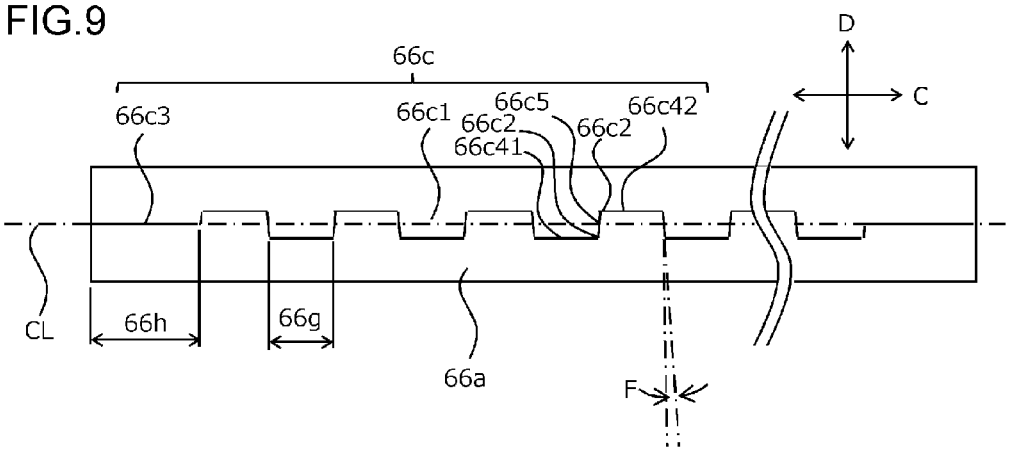
FIG. 9 is a front view of a joint of a shaft portion of the roller according to Embodiment 1 of the present invention.

The configuration of the charging roller 66 will be described with reference to FIGS. 1A to 1C, 8, and 9. FIGS. 1A to 1C are explanatory diagrams of the charging roller 66 according to the present embodiment. FIG. 1A is a schematic top view for describing a contact state between the drum 62 and the charging roller 66 according to the present embodiment. FIG. 1B is a partial detail view illustrating a load distribution of the sheet metal joint 66*c* of the shaft portion 66*a*. FIG. 1C is a partial detail view illustrating a load distribution of the sheet metal joint 66*c* of the shaft portion 66*a* according to a comparative example. FIG. 8 is a schematic cross-sectional view illustrating a process of processing the shaft portion 66*a* of the present embodiment in a cylindrical form from a sheet metal. FIG. 8 is a cross-sectional view when a sheet metal 66*a*1 is seen in the extension direction (axial direction) C of an axial line CL of the shaft portion 66*a* of the charging roller 66 illustrated in FIG. 9. FIG. 9 is a front view of the sheet metal joint 66*c* of the shaft portion 66*a* according to the present embodiment.

As illustrated in FIG. 1A, the charging roller 66 of the present embodiment is disposed so as to make contact with the drum 62 in an inclined attitude so that a crossing angle θ (first angle) is formed between an axial line 62L of the drum and an axial line 66L of the charging roller 66. Here, the axial line 66L of the charging roller 66 and the axial line 62L of the drum 62 do not cross each other actually since the axial lines are in a twisted positional relation. In the description of the present embodiment, an apparent crossing angle between the axial line 66L and the axial line 62L when the charging roller 66 and the drum 62 are simultaneously seen from an upper side of the charging roller 66 as illustrated in FIG. 1A (an overlap angle of the axial lines when the charging roller 66 and the drum 62 are projected in a direction orthogonal to the axial line of the charging roller 66 or the drum 62) is referred to as the crossing angle θ. This crossing angle θ can be regarded as being the same as a crossing angle of generating lines of the circumferential surfaces that pass through a contact point of the charging roller 66 and the drum 62. Therefore, in the following description, the crossing angle θ of the axial lines 66L and 62L will be appropriately referred to as the crossing angle θ of the generating lines.

By forming the crossing angle θ, the contact pressure of the charging roller 66 on the drum 62 is uniformized and the positioning in the longitudinal direction of the charging roller 66 is realized. Since the contact state between the charging roller 66 and the drum 62 is unstable if the crossing angle θ is too large, it is preferable that θ is between 0.05° and 2.5°. When the drum 62 rotates in the direction indicated by arrow R, the charging roller 66 rotates in the direction indicated by arrow S by receiving drive force Q having an inclination of the crossing angle θ from the generating line of the drum 62 via the generating line of the charging roller 66.

As illustrated in FIG. 8, the shaft portion 66*a* (a cylindrical shaft) of the charging roller 66 is a press-molded body. That is, the shaft portion 66*a* is formed by bending (for example, press-processing) a conductive planar sheet metal (stainless steel plate, SUM22 plated with Ni, and the like) 66*a*1 in a cylindrical form in order to reduce the weight and the cost of the cartridge B and the apparatus main body A. When the sheet metal 66*a*1 is press-processed, the sheet metal 66*a*1 is formed so that the sheet metal joint 66*c* of the sheet metal extends from one end (an end on one side) in an axial direction C of the shaft portion 66*a* to the other end (an end on the other side) (FIG. 9). That is, the shaft portion 66*a* has a configuration in which a cross-section vertical to the axial direction C has an approximately C-shape and the shaft portion has a pair of ends (end surfaces) that faces or makes contact with each other in the circumferential direction. The pair of ends facing each other in the circumferential direction forms the joint 66*c* (sometimes referred to as a knot). Since the shaft portion 66*a* can be regarded as having such a configuration that the cylindrical shape is separated by the joint 66*c*, the joint 66*c* can be referred to as a separation portion.

Here, in the present embodiment, an outer diameter of the shaft portion 66*a* is ϕ 6 mm and an entire length in the axial direction C is 252.5 mm. However, the outer diameter and the entire length may be set appropriately depending on the required function.

As illustrated in FIG. 9, in the present embodiment, the joint 66*c* has a shape such that a plurality of depression-protrusion portions 66*c*1 which engage with each other in the circumferential direction is formed rather than a shape such that the joint 66*c* extends just linearly in the axial direction C. The depression-protrusion-shaped portions extending in the axial direction are formed in one end and the other end of the joint 66*c* of the shaft portion 66*a* and the depression-protrusion-shaped portions engage with each other so that the shaft portion 66*a* has desired strength. Although it is preferable that the larger the number of depressions and protrusions, the stronger the strength of the shaft portion 66*a*, the required strength may be selected appropriately depending on manufacturing conditions and product functions.

The depression-protrusion portion 66*c*1 that forms the depression-protrusion-shaped portion in one end and the other end of the joint 66*c* of the shaft portion 66*a* includes a plurality of corner portions 66*c*2, a plurality of depression bottom portions 66*c*41, a plurality of protrusion distal ends 66*c*42, and a plurality of side surface portions 66*c*5. The depression bottom portion 66*c*41 and the protrusion distal end 66*c*42 are parallel portions that extend approximately parallel to the axial direction C and the side surface portion 66*c*5 is a non-parallel portion that is not parallel to the axial direction C. The protrusion distal end 66*c*42 and the side surface portion 66*c*5 which are adjacent to each other and the side surface portion 66*c*5 and the depression bottom portion 66*c*41 which are adjacent to each other are connected by the corner portion 66*c*2. For example, the depression bottom portion 66*c*41, the corner portion 66*c*2, the side surface portion 66*c*5, the protrusion distal end 66*c*42, the corner portion 66*c*2, the side surface portion 66*c*5, and the corner portion 66*c*2 are arranged repeatedly in that order in the axial direction C whereby the depression-protrusion portion 66*c*1 is formed.

That is, the depression and the protrusion of the depression-protrusion portion 66*c*1 share one side surface portion 66*c*5 and are alternately formed in the axial direction C. That is, a configuration formed by one depression bottom portion 66*c*41, two corner portions 66*c*2 at both ends thereof, and two side surface portions 66*c*5 connected to these portions can be regarded as a depression of the depression-protrusion portion 66*c*1. Moreover, a configuration formed by one protrusion distal end 66*c*42, two corner portions 66*c*2 at both ends thereof, and two side surface portions 66*c*5 connected to these portions can be regarded as a protrusion of the depression-protrusion portion 66*c*1.

The depression-protrusion portion 66*c*1 has a symmetrical configuration in which the arrangement of the depression bottom portion 66*c*41 and the protrusion distal end 66*c*42 at one end and the other end of the joint 66*c* of the shaft portion 66*a* are switched in the axial direction C. Due to this, a protrusion at one end of the joint 66*c* engages with a depression at the other end, and a protrusion at the other end engages with a depression at one end. That is, the protrusion distal end 66*c*42 that forms the protrusion at one end and the depression bottom portion 66*c*41 that forms the depression at the other end face each other in the circumferential direction. Similarly, the depression bottom portion 66*c*41 that forms the depression at one end and the protrusion distal end 66*c*42 that forms the protrusion at the other end face each other in the circumferential direction.

The side surface portion 66*c*5 of the depression at one end and the side surface portion 66*c*5 at the other end which face each other have facing surfaces that face or make contact with each other in a direction inclined with respect to the circumferential direction and the axial direction C, which will be described in detail later (that is, the facing surfaces extend in a direction that is not parallel to the axial direction). The pair of side surface portions 66*c*5 that forms the depression of the depression-protrusion portion 66*c*1 is inclined so that the facing width in the axial direction C narrows gradually toward the depression bottom portion 66*c*41. Moreover, the pair of side surface portions 66*c*5 that forms the protrusion of the depression-protrusion portion 66*c*1 is inclined so that the facing width in the axial direction C narrows gradually toward the protrusion distal end 66*c*42.

A linear portion 66*c*3 is provided on both sides of the depression-protrusion portion 66*c*1 at one end and the other end of the joint 66*c* so as to extend up to the end in the axial direction C.

A longitudinal width 66*h* of the linear portion 66*c*3 in the axial direction C of the charging roller 66 is a spindle portion that is rotatably supported by the charging roller bearings 67L and 67R (FIG. 6). From the viewpoint of preventing wearing of the charging roller bearings 67L and 67R (FIG. 6), it is preferable that the side surface portion 66*c*5 and the corner portion 66*c*2 are not included in the spindle portion. Due to this, the longitudinal width 66*h* is provided to be longer than a longitudinal width 66*g* of the depression distal end 66*c*41 or the protrusion distal end 66*c*42 so that an engagement width in the longitudinal direction of the spindle portion is secured. In the present embodiment, the longitudinal width 66*h* of the linear portion 66*c*3 is 16 mm, and the longitudinal width 66*g* of the depression distal end 66*c*41 and the protrusion distal end 66*c*42 is 10.5 mm. A specific dimension is not limited to this, but the longitudinal width 66*h* of the linear portion 66*c*3 may be between 4 and 30 mm and the longitudinal width 66*g* of the depression distal end 66*c*41 and the protrusion distal end 66*c*42 may be set appropriately to a desired dimension smaller than the longitudinal width 66*h* of the linear portion 66*c*3.

Although the outer diameter of the shaft portion 66*a* is ϕ 6 mm and the inner diameter is ϕ 4.8 mm, the outer diameter may be between 3 and 15 mm and the inner diameter may be set appropriately to a desired dimension obtained by subtracting the thickness (0.3 to 2 mm) of the sheet metal 66*a*1 from the outer diameter of the shaft portion 66*a*. The inner diameter shape of the shaft portion 66*a* may not be circular if this shape is not necessary for product functions and manufacturing conditions. Although it is preferable from the viewpoint of strength that the depression-protrusion portions 66*c*1 of the sheet metal joint 66*c* engage with each other without any gap, a gap may be formed in a portion of the depression-protrusion portions 66*c*1.

As illustrated in FIG. 1B, an engagement angle F (a second angle) inclined at a predetermined angle with respect to the direction D (the circumferential direction of the outer circumference of the shaft portion 66*c*) vertical to the axial direction C of the shaft portion 66*a* is formed between the depression distal end 66*c*41 or the protrusion distal end 66*c*42 and the side surface portion 66*c*5 continuous thereto. As illustrated in FIG. 1B, the engagement angle F is configured so as to satisfy the relation of "crossing angle θ"<"engagement angle F". In the present embodiment, the engagement angle F is 3°. That is, the charging roller 66 according to the present embodiment is disposed in contact with the drum 62 so that the generating line of the circumferential surface of the elastic layer 66*b* crosses the generating line of the circumferential surface of the drum 62 at the crossing angle θ (first angle) smaller than the engagement angle F (second angle).

By disposing the charging roller 66 in this manner, the load U (arrow in FIG. 1B) when the charging roller 66 receives the drive force Q during rotation of the drum 62 is distributed to the depression bottom portion 66*c*41 or the protrusion distal end 66*c*42 of the joint 66*c* and the side surface portions 66*c*5 on both sides. When the load U is distributed in this manner, since an influence resulting from local concentration of load (for example, concentration of load on single side surface portion 66*c*5 (FIG. 1C)) does not occur, deterioration of cylindricity and total deflection of the shaft portion 66*a* is suppressed. As a result, it is possible to suppress non-uniform rotation of the charging roller 66 depending on a rotation cycle of the shaft portion 66*a* and to suppress non-uniform charging or the like and to secure a satisfactory image quality.

FIG. 1C illustrates a configuration that satisfies the relation "crossing angle θ"≥"engagement angle F" as a comparative example in which the present invention is not implemented. In such a configuration as illustrated in FIG. 1C, the load of the shaft portion 66*a* having received the drive force Q may concentrate on one side surface portion 66*c*5 on a single side of one depression or protrusion, and stress may be distributed non-uniformly in the longitudinal direction of one depression or protrusion. When stress acts non-uniformly in this manner, the circularity of the circumferential surface of the shaft portion 66*a* deteriorates and the cylindricity and the total deflection (the degree of deflection of the entire roller circumferential surface when the charging roller 66 is rotated) of the charging roller 66 deteriorates. As a result, the rotation and the charging of the charging roller 66 become non-uniform depending on the rotation cycle of the shaft portion 66*a*, which may cause image defects.

Due to the above-described configuration of the present embodiment, it is possible to provide a conductive roller capable of suppressing deterioration of cylindricity and total deflection and a process cartridge and an image forming apparatus which use the conductive roller. Although an example in which the conductive roller of the present invention is applied to a charging roller of a cartridge has been illustrated in the present embodiment, the present invention is not limited to this but the conductive roller may be applied to a developing roller. That is, in the present embodiment, although a case in which a cleaning unit having a charging roller as a first rotating member and a photosensitive drum having a second rotating member corresponds to a rotating member unit according to the present invention has been described, a configuration to which the present invention can be applied is not limited to this. For example, the present invention may be applied to a configuration including a developing roller as a first rotating member and a photosensitive drum as a second rotating member. When the present invention is applied to such an apparatus configuration, it is possible to rotate the developing roller 32 stably. When developing is performed in a state in which the developing roller 32 is in contact with the drum 62, it is possible to maintain a stable contact state. Therefore, it is possible to perform developing stably and to suppress image defects. Moreover, the process cartridge may be incorporated into an image forming apparatus main body which does not employ a cartridge system and a smallest unit of the conductive roller only may be detachably attached to a cartridge or an apparatus main body.

Embodiment 2

Embodiment 2 of the present invention will be described. In Embodiment 2, constituent elements similar to those of Embodiment 1 will be denoted by the same reference numerals as Embodiment 1 and the description thereof will be omitted. That is, constituent elements which are not described particularly in Embodiment 2 are similar to those of Embodiment 1.

Figure 11:
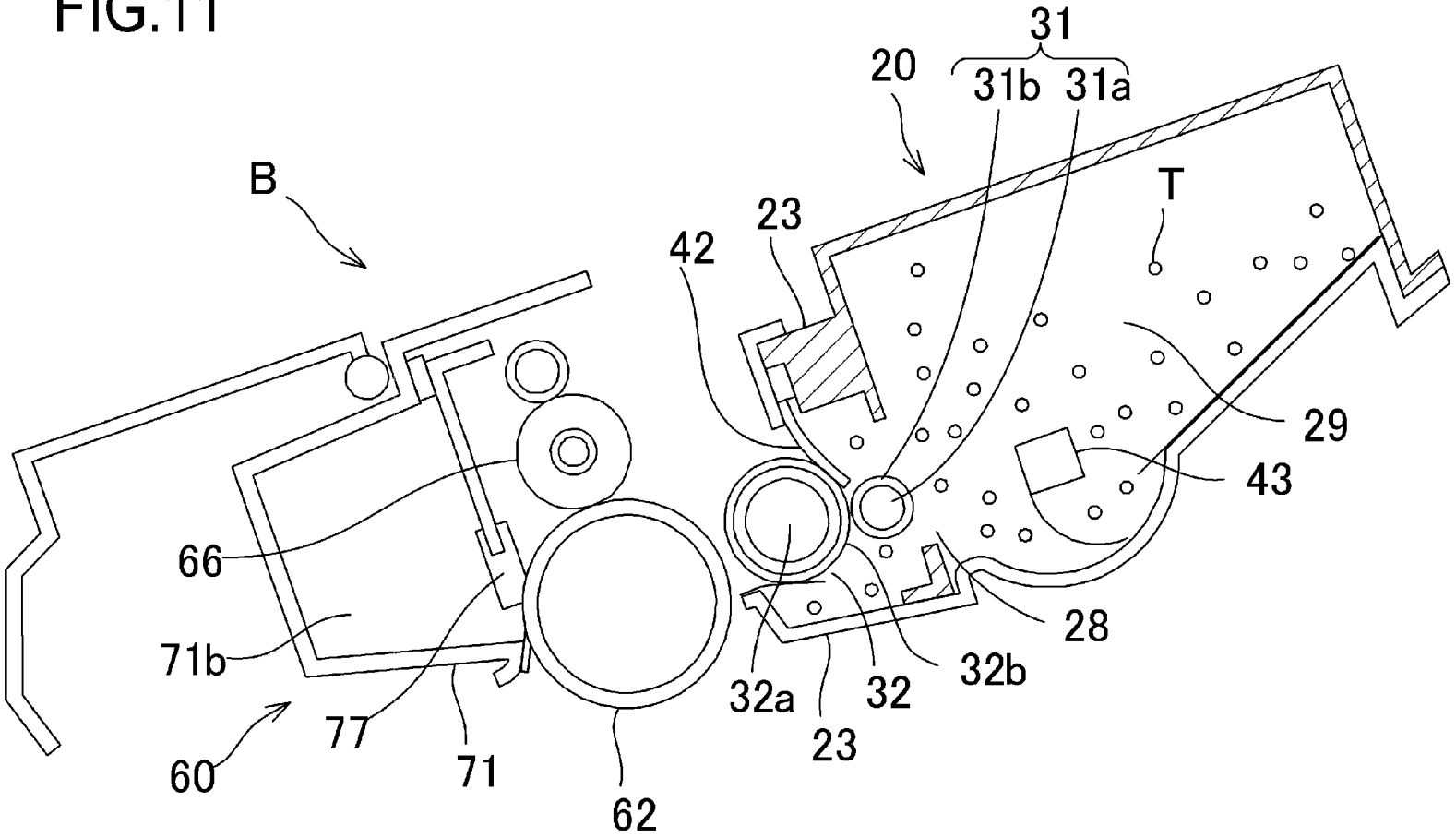
FIG. 11 is a schematic cross-sectional view of a process cartridge according to Embodiment 2 of the present invention.

FIG. 11 is a schematic cross-sectional view illustrating a schematic configuration of a process cartridge according to the present embodiment. A process cartridge according to the present embodiment includes a supply roller 31 in addition to the same constituent elements as those of the process cartridge according to Embodiment 1. That is, as illustrated in FIG. 11, toner T in the toner supply chamber 28 is supplied to the surface of the developing roller 32 as a first roller (first rotating member) by the supply roller 31. In the present embodiment, the developing roller 32 and the photosensitive drum 62 as a first roller (a second rotating member) correspond to a roller unit (a rotating member unit).

<Configuration of Developing Unit 20>

Figure 12:
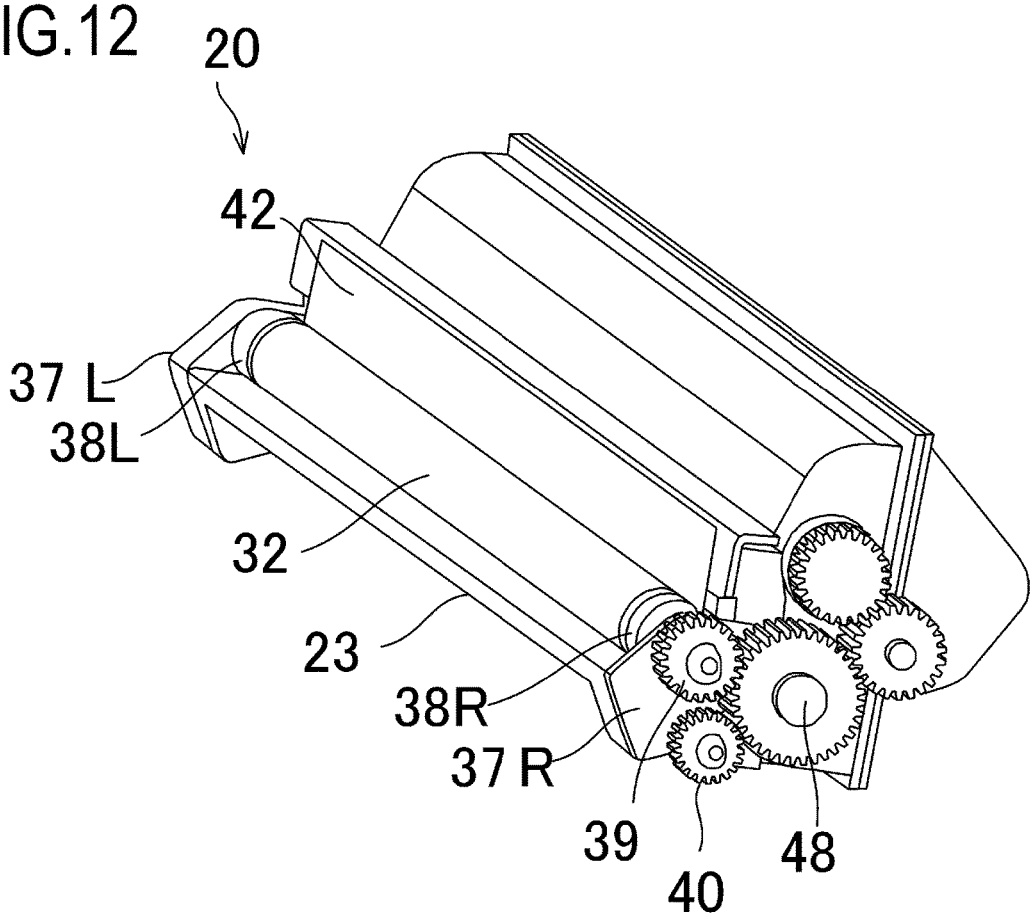
FIG. 12 is a perspective view illustrating a state in which a side member is detached from a developing unit.

Next, a configuration of the developing unit 20 will be described with reference to FIGS. 11 and 12. FIG. 12 is a schematic perspective view illustrating a state in which the first side member 26L and the second side member 26R are detached from the developing unit 20. As illustrated in FIG. 11, a developing frame 23 in which toner is stored, the developing roller 32, and the supply roller 31 that supplies toner to the developing roller 32 are provided in the developing unit 20.

The developing roller 32 includes a shaft portion 32*a* which is a hollow cylindrical shaft formed of metal and a conductive elastic layer 32*b* as a coating layer. The elastic layer 32*b* of the developing roller 32 coats an entire region in the longitudinal direction of the shaft portion 32*a* excluding both ends of the shaft portion 32*a*. Moreover, as described above, the elastic layer 32*b* and the shaft portion 32*a* are bonded by an adhesive. The supply roller 31 includes a hollow shaft portion 31*a* formed of metal and a conductive elastic layer 31*b*, and the elastic layer 31*b* coats an entire region in the longitudinal direction of the shaft portion 31*a* excluding both ends of the shaft portion 31*a*. The elastic layer 31*b* and the shaft portion 31*a* are bonded by an adhesive.

The shaft portion 32*a* of the developing roller 32 and the shaft portion 31*a* of the supply roller 31 are rotatably supported by a bearing member 37L and a bearing member 37R, respectively, as illustrated in FIG. 12. A developing roller gear 39 and a supply roller gear 40 are fitted into one set of driving-side ends of the developing roller 32 and the supply roller 31, respectively. Moreover, the developing roller gear 39 and the supply roller gear 40 engage with an input gear 48. The developing roller gear 39, the supply roller gear 40, and the input gear 48 are configured as helical gears in order to suppress a power transmission error in engagement of toothed surfaces. The input gear 48 rotates upon receiving drive force from a drive transmission mechanism (not illustrated) provided in the apparatus main body A of the image forming apparatus S. The developing roller gear 39 and the supply roller gear 40 rotate with rotation of the input gear 48.

<Configuration of Developing Roller 32>

Figure 10A:
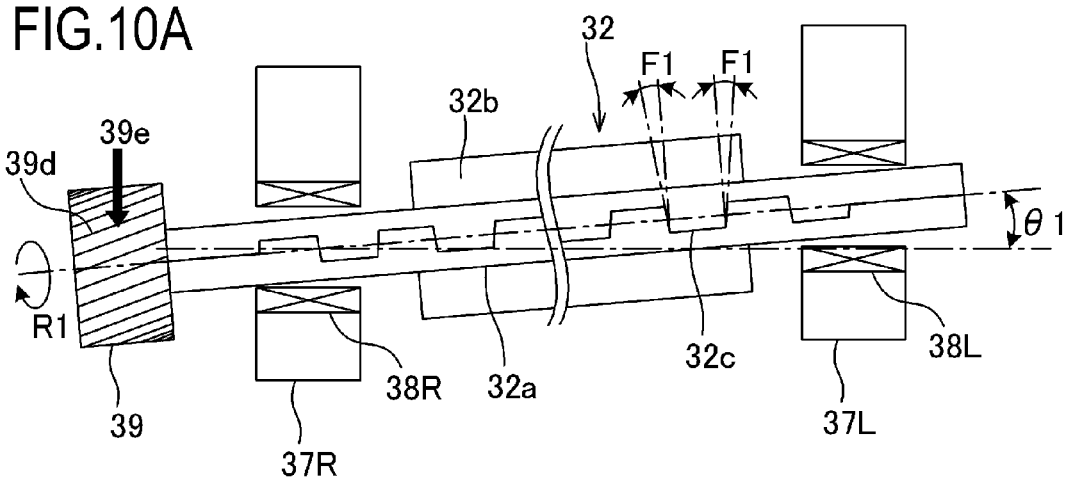
FIGS. 10A to 10C are diagrams illustrating a configuration of a roller (a developing roller) according to Embodiment 2 of the present invention.
Figure 10B:
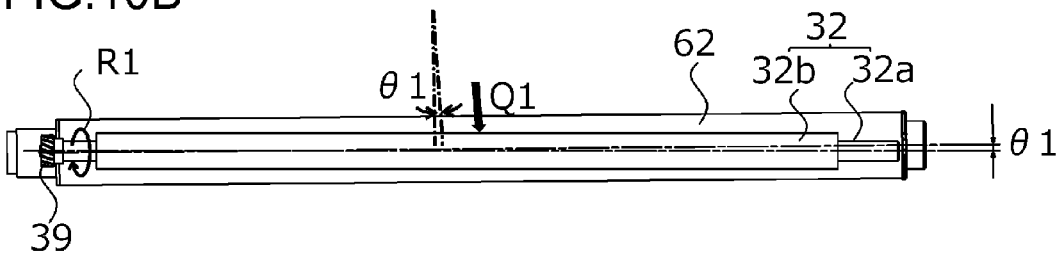
Figure 10C:
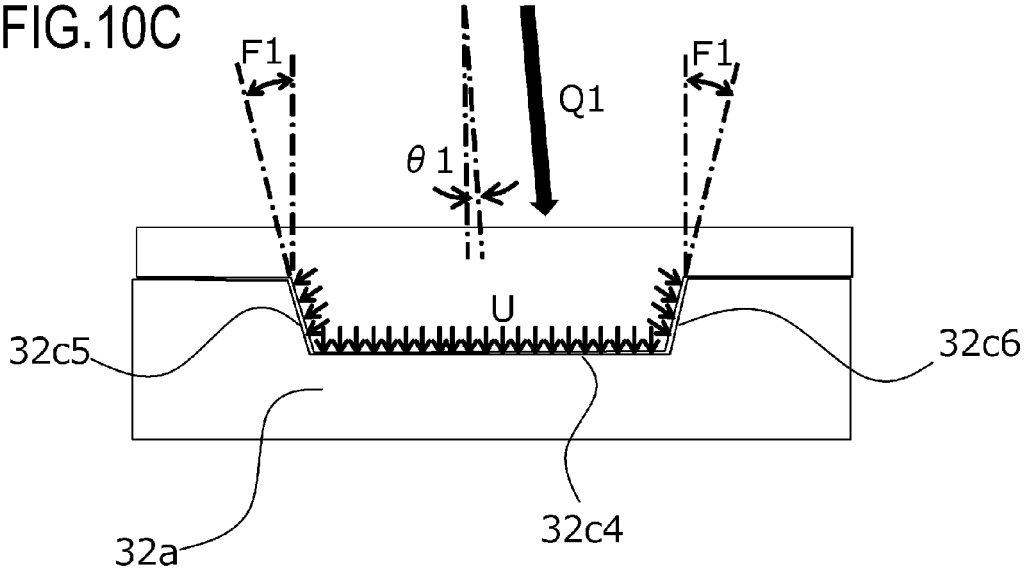

Next, a configuration of the developing roller 32 will be described with reference to FIGS. 10A to 10C, FIGS. 13A and 13B, FIG. 14, FIGS. 15A and 15B, and FIG. 16. FIGS. 10A to 10C are diagrams illustrating a configuration of the developing roller 32 according to Embodiment 2. Specifically, FIG. 10A is a top view illustrating a state in which the developing roller 32 according to Embodiment 2 is supported. FIG. 10B is a top view illustrating a contact state between the photosensitive drum 62 and the developing roller 32 according to Embodiment 2. FIG. 10C is a diagram illustrating a distribution of load applied to a joint 32*c* (corresponding to a joint portion) of the shaft portion 32*a*.

Figure 13A:
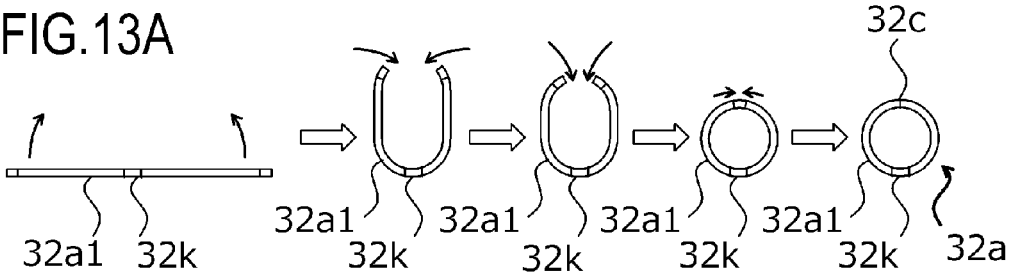
FIGS. 13A and 13B are schematic diagrams illustrating a process of processing a sheet metal in a cylindrical shape to form a shaft portion.
Figure 13B:
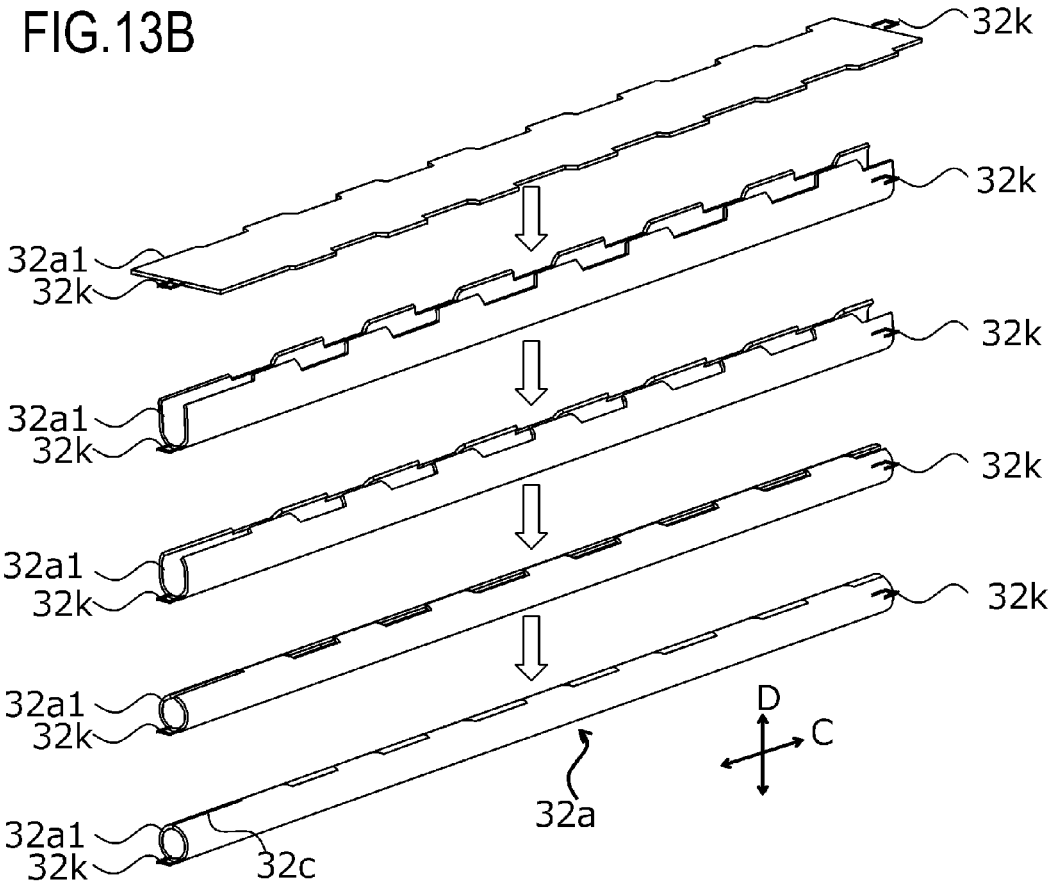
Figure 14:
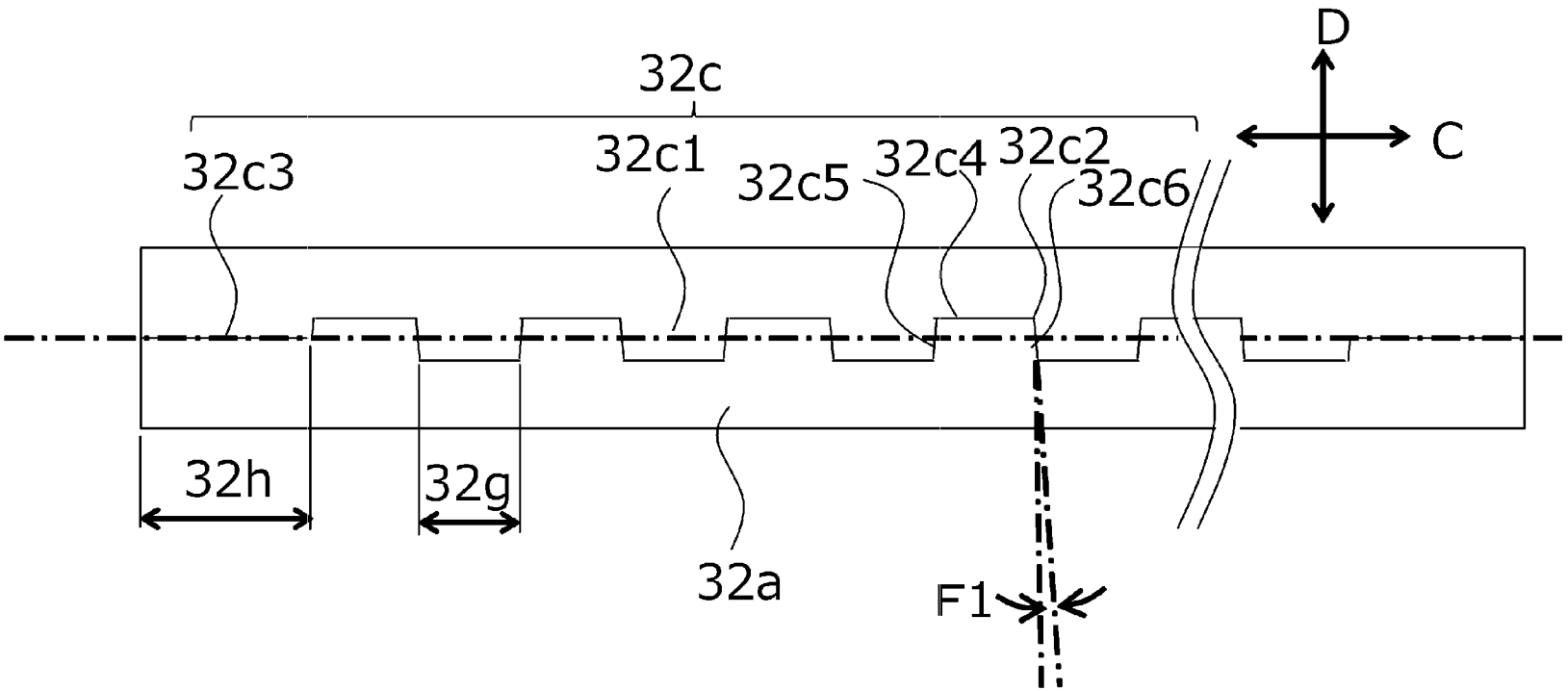
FIG. 14 is a front view illustrating a joint of a shaft portion according to Embodiment 2 of the present invention.
Figure 15A:
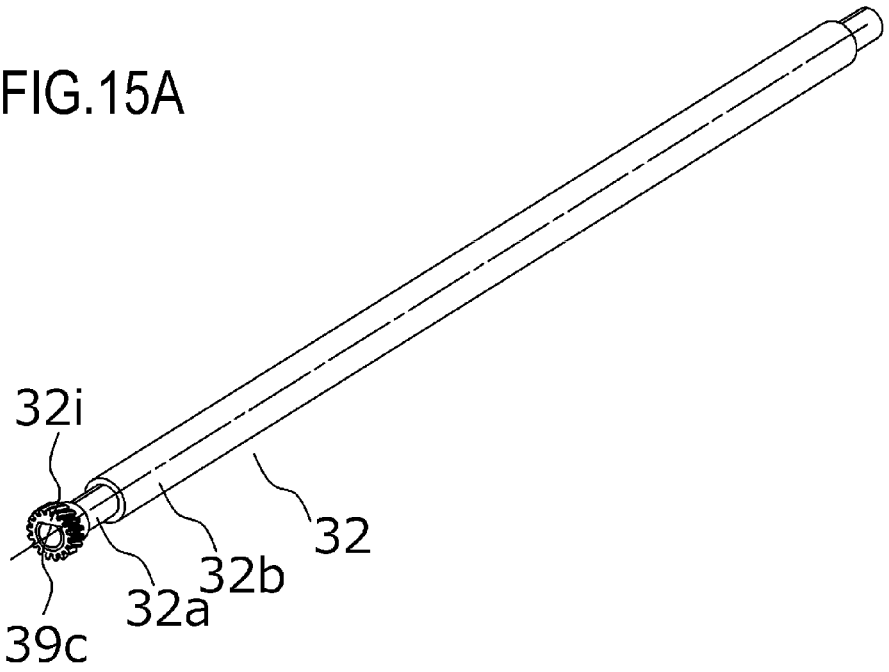
FIGS. 15A and 15B are exploded perspective views illustrating a configuration of a developing roller gear and a developing roller according to Embodiment 2 of the present invention.
Figure 15B:
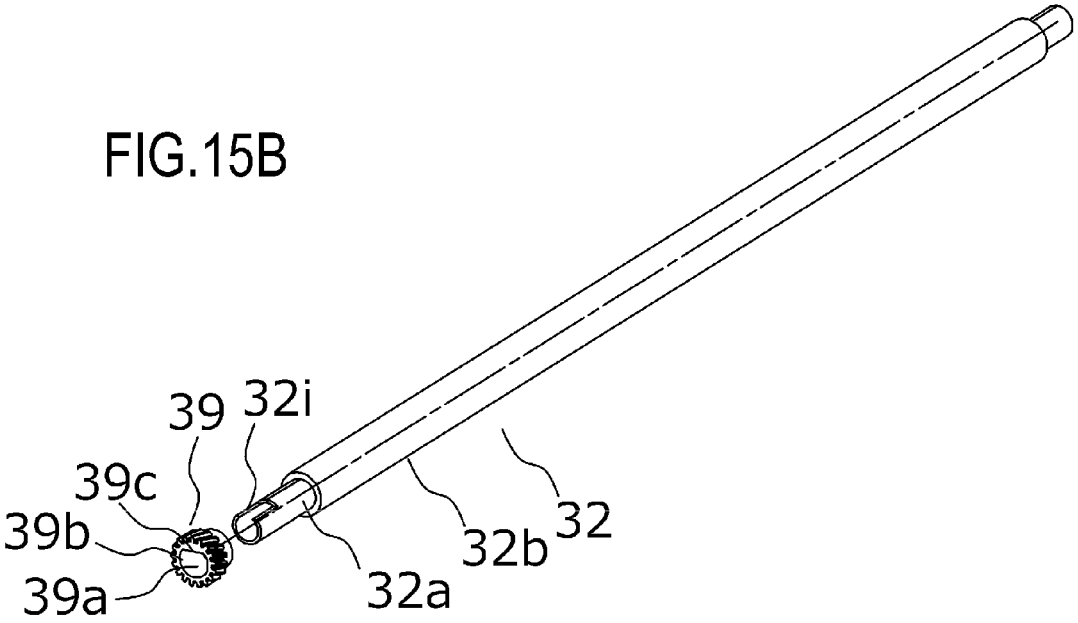
Figure 16:
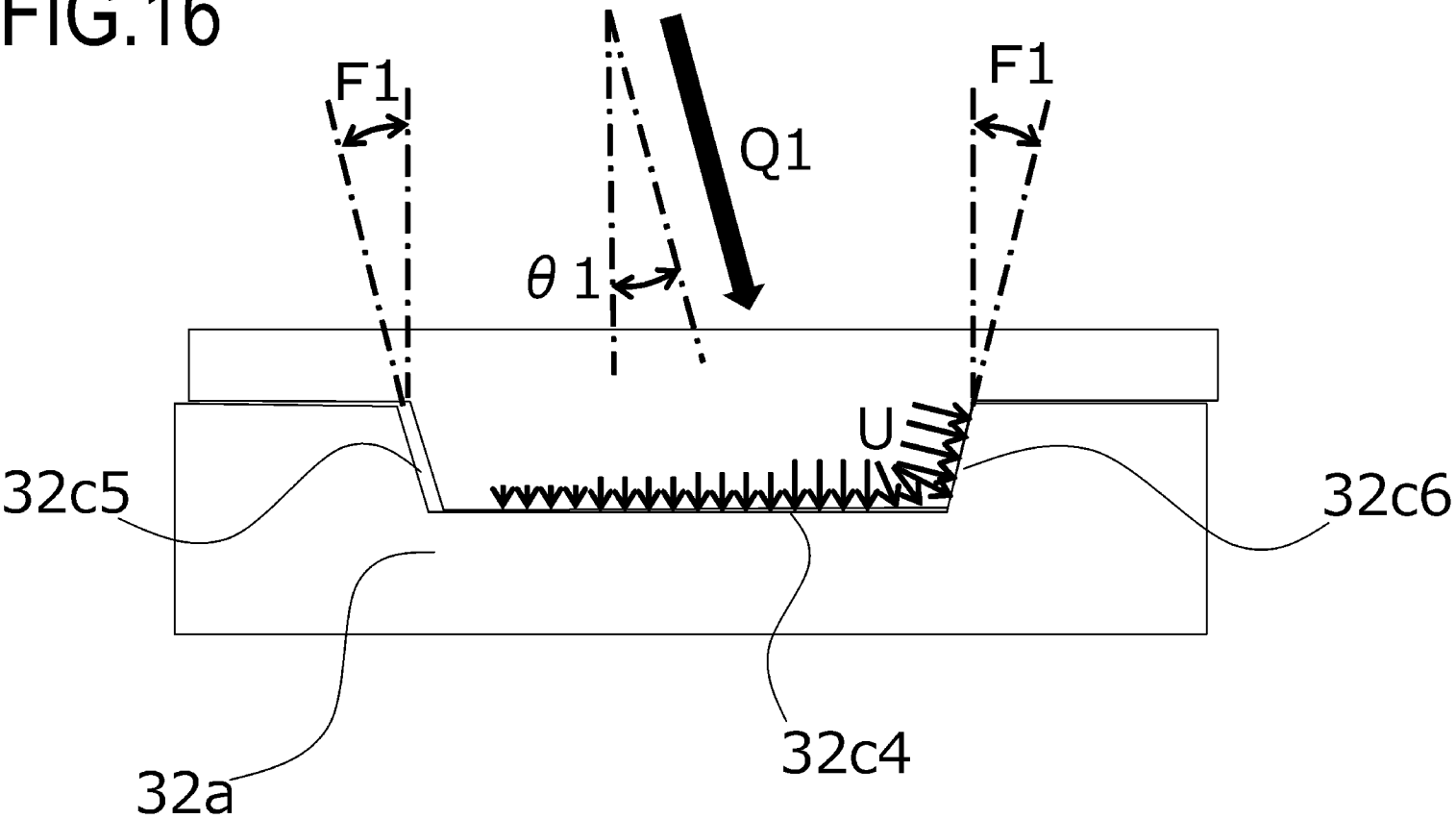
FIG. 16 is a diagram illustrating a distribution of load applied to a joint of a shaft portion according to a comparative example.

FIGS. 13A and 13B are schematic diagrams illustrating a process of processing a sheet metal in a cylindrical shape to form the shaft portion 32*a*. FIG. 14 is a front view illustrating the joint 32*c* of the shaft portion 32*a* according to Embodiment 2. FIGS. 15A and 15B are exploded perspective views illustrating a configuration of the developing roller 32 and the developing roller gear 39 according to Embodiment 2. FIG. 16 is a diagram illustrating a distribution of load applied to the joint 32*c* of the shaft portion 32*a* according to a comparative example.

As illustrated in FIG. 10A, a developing roller spindle portion 38L and a developing roller spindle portion 38R that rotatably support the shaft portion 32*a* of the developing roller 32 are provided in the bearing member 37L and the bearing member 37R, respectively. A portion of an outer circumferential surface at one end in the longitudinal direction of the shaft portion 32*a* of the developing roller 32 is notched in a radial direction to form a notch portion 32*i* as illustrated in FIG. 15B. On the other hand, a through-hole 39*a* is formed so as to pass through the developing roller gear 39 in the longitudinal direction. The through-hole 39*a* includes an inner circumferential surface 39*b* that is coaxial to a pitch circle of the developing roller gear 39 and a drive transmission surface 39*c* that faces an axial line of the inner circumferential surface 39*b*.

As illustrated in FIG. 15A, the developing roller gear 39 is inserted into the shaft portion 32*a* of the developing roller 32 in the longitudinal direction in a state in which the drive transmission surface 39*c* and the notch portion 32*i* face each other. When the input gear 48 (see FIG. 12) rotates, the developing roller gear 39 rotates and rotation drive force is transmitted to the notch portion 32*i* of the developing roller 32 via the drive transmission surface 39*c*. The developing roller 32 receives the rotation drive force from the notch portion 32*i* and rotates in the direction indicated by arrow R while being supported by the developing roller spindle portion 38L and the developing roller spindle portion 38R as illustrated in FIG. 10A.

Here, in a state in which the developing roller 32 rotates, the toothed surfaces of the developing roller gear 39 receives engagement force 39*e* from the input gear 48 (see FIG. 12) as illustrated in FIG. 10A. The engagement force 39*e* acts on one set of ends in the longitudinal direction of the bearing members 37L and 37R. Due to this, load is applied to one end side in the axial direction of the center of rotation of the shaft portion 32*a*. Moreover, since a small gap is present between the shaft portion 32*a* and the developing roller spindle portions 38L and 38R, the shaft portion 32*a* is inclined.

When the shaft portion 32*a* is inclined, the load applied from the shaft portion 32*a* to the developing roller spindle portions 38L and 38R concentrates on one location. That is, the load applied from the shaft portion 32*a* to the developing roller spindle portions 38L and 38R concentrates on a single side of the developing roller spindle portions 38L and 38R. Due to this, in order for the cartridge B to form a toner image, as illustrated in FIG. 10B, the outer circumferential surface of the developing roller 32 and the outer circumferential surface of the photosensitive drum 62 make contact with each other in a state in which the axial line of the center of rotation of the developing roller 32 is inclined with respect to the axial line of the center of rotation of the photosensitive drum 62. Due to this, an axial line θ1 is formed between the axial line of the center of rotation of the developing roller 32 and the axial line of the center of rotation of the photosensitive drum 62. In this way, the developing roller 32 receives sliding resistance Q1 at the contact portion contacting the photosensitive drum 62 as reaction force from the photosensitive drum 62. The sliding resistance Q1 is inclined by a crossing angle θ with respect to the direction orthogonal to the rotation axis direction of the developing roller 32 (the rotation axis direction of the shaft portion 32*a*).

Here, in the present embodiment, as illustrated in FIGS. 13A and 13B, the shaft portion 32*a* is formed by press-processing a conductive sheet metal (stainless steel plate, SUM22 plated with Ni, and the like) 32*a*1 in a cylindrical form. In this way, it is possible to reduce the weight and the cost of the cartridge B and the apparatus main body A. As illustrated in FIG. 13B, the press-processing is performed in a state in which protrusions 32*k* provided at both ends in the longitudinal direction of the sheet metal 32*a*1 are supported by a press machine (not illustrated).

A press mold (not illustrated) bends the sheet metal 32*a*1 in a state in which the protrusions 32*k* are supported whereby the cylindrical shaft portion 32*a* is formed. When the shaft portion 32*a* is formed, the joint 32*c* of the sheet metal 32*a*1 is formed along the axial direction of the shaft portion 32*a*. That is, the outer circumferential surface of the shaft portion 32*a* is disconnected in the circumferential direction of the shaft portion 32*a* while extending from one end to the other end of the shaft portion 32*a* in the axial direction of the center of rotation of the shaft portion 32*a*. Moreover, the joint 32*c* is formed by the facing ends in the circumferential direction of the shaft portion 32*a*.

In the present embodiment, the protrusion and the depression of the joint 32*c* are continuously and alternately formed on one side and the other side from one end to the other end of the shaft portion 32*a* in the axial direction of the center of rotation of the shaft portion 32*a*. Depressions and protrusions are formed on one side and the other side of a disconnected portion of the shaft portion 32*a*. In the present embodiment, an outer diameter of the shaft portion 32*a* is ϕ 6 mm, and an entire length of the shaft portion 32*a* in the axial direction C (see FIG. 13B) of the shaft portion 32*a* is 252.5 mm. However, the outer diameter and the entire length may be set appropriately depending on the required function.

As illustrated in FIG. 14, the joint 32*c* provides the shaft portion 32*a* with desired strength by fitting a plurality of depression-protrusion portions 32*c*1 together. Specifically, a protrusion on one side of the joint 32*c* is fitted to a depression on the other side, and a protrusion on the other side is fitted to a depression on one side whereby one side of the joint 32*c* is connected to the other side. Although the strength of the shaft portion 32*a* is improved as the number of depression-protrusion portions 32*c*1 increases, the required strength may be selected appropriately depending on the productivity of the shaft portion 32*a* and the product function of the image forming apparatus S. Moreover, the depression-protrusion portion 32*c*1 includes a corner portion 32*c*2, a linear portion 32*c*3, one depression-protrusion portion 32*c*4, a first longitudinal side surface 32*c*5, and a second longitudinal side surface 32*c*6. In the shaft portion 32*a*, the linear portion 32*c*3 is provided at both ends in the axial direction of the shaft portion 32*a*. One depression-protrusion portion 32*c*4, the first longitudinal side surface 32*c*5, and the second longitudinal side surface 32*c*6 are provided sequentially between the linear portions 32*c*3 with the corner portion 32*c*2 interposed therebetween. In FIG. 14, the first longitudinal side surface 32*c*5, one depression-protrusion portion 32*c*4, and the second longitudinal side surface 32*c*6 are successively provided in that order from left to right.

Here, the longitudinal width 32*h* of the linear portion 32*c*3 is a portion which is rotatably supported by the developing roller spindle portions 38L and 38R (see FIGS. 10A to 10C). Moreover, it is preferable that the linear portion 32*c*3 does not include the first longitudinal side surface 32*c*5, the second longitudinal side surface 32*c*6, and the corner portion 32*c*2. This is to suppress the developing roller spindle portions 38L and 38R from being worn out by making contact with the first longitudinal side surface 32*c*5 or the like.

In the present embodiment, the longitudinal width 32*h* is longer than the longitudinal width 32*g* of one depression-protrusion portion 32*c*4 in the axial direction of the shaft portion 32*a*. Moreover, in the present embodiment, in the axial direction of the shaft portion 32*a*, the longitudinal width 32*h* of the linear portion 32*c*3 is 16 mm and the longitudinal width 32*g* of one depression-protrusion portion 32*c*4 is 10.5 mm. In the axial direction of the shaft portion 32*a*, the longitudinal width 32*h* of the linear portion 32*c*3 may be between 2 and 30 mm, and the longitudinal width 32*g* of one depression-protrusion portion 32*c*4 may be equal to or smaller than the longitudinal width 32*h* of the linear portion 32*c*3.

In the present embodiment, although the outer diameter of the shaft portion 32*a* is ϕ 6 mm and the inner diameter of the shaft portion 32*a* is ϕ 4.8 mm, the dimensions are not necessarily limited thereto. For example, the outer diameter of the shaft portion 32*a* may be between 3 and 15 mm, and the inner diameter of the shaft portion 32*a* may be set appropriately to a desired dimension obtained by subtracting the thickness (0.3 to 2 mm) of the sheet metal 32*a*1 from the outer diameter of the shaft portion 32*a*. The cross-sectional shape of the shaft portion 32*a* may not be circular if the shape is not particularly necessary for product functions during the manufacturing process of the image forming apparatus S.

Although it is preferable from the viewpoint of strength that the depression-protrusion portions 32*c*1 of the joint 32*c* are formed without any gap, a gap may be formed in a portion of the depression-protrusion portions 32*c*1. An engagement angle F1 is formed between one depression-protrusion portion 32*c*4 and the first longitudinal side surface 32*c*5 with respect to the direction D orthogonal to the axial direction C of the shaft portion 32*a*. Similarly, the engagement angle F1 is provided between one depression-protrusion portion 32*c*4 and the second longitudinal side surface 32*c*6.

In the present embodiment, the protrusion of one depression-protrusion portion 32*c*4 has such a shape that the width narrows in the protruding direction of the protrusion. Moreover, the depression of one depression-protrusion portion 32*c*4 has such a shape that the width narrows in the depressing direction of the depression. In the present embodiment, the angle between the circumferential direction of the shaft portion 32*a* and each of the two sides that sandwiches one of the three sides with which the protrusion and the depression make contact is referred to as an engagement angle F1. In other words, the shaft portion 32*a* includes facing surfaces which face or make contact with each other and form the depression-protrusion-shaped portion of the joint 32*c* and which extend in a direction non-parallel to the axial direction of the center of rotation of the shaft portion 32*a*. The angle between the facing surface and the circumferential direction of the shaft portion 32*a* is referred to as the engagement angle F1. Moreover, the angle between the axial line of the center of rotation of the shaft portion 32*a* and the axial line of the center of rotation of the photosensitive drum 62 is referred to as a crossing angle θ1. Specifically, the engagement angle F1 is the angle between each of two sides that sandwich one of the three sides with which the protrusion and the depression make contact and a plane that passes through one point on the side and is orthogonal to the shaft portion 32*a*.

In the present embodiment, the engagement angle F1 satisfies the relation of "crossing angle θ1"<"engagement angle F1" as illustrated in FIG. 10C. Specifically, in the present embodiment, the engagement angle F1 is set to 3°. Since the developing roller 32 is configured in this manner, the load U (see FIG. 10C) when the developing roller 32 receives sliding resistance Q1 from the photosensitive drum 62 when the photosensitive drum 62 is rotating is distributed to both the first longitudinal side surface 32*c*5 and the second longitudinal side surface 32*c*6.

When the load U is distributed to both the first and second longitudinal side surfaces 32*c*5 and 32*c*6, the load applied to the shaft portion 32*a* does not concentrate on the first longitudinal side surface 32*c*5 or the second longitudinal side surface 32*c*6 only. In this way, deterioration of the cylindricity and the total deflection of the shaft portion 32*a* is suppressed. As a result, since the developing roller 32 rotates stably, it is possible to suppress a blur in the developed toner image. In this way, it is possible to obtain a satisfactory image.

FIG. 16 illustrates a shaft portion 32*a* that satisfies the relation of "crossing angle θ1"≥"engagement angle F1" as a comparative example. In the comparative example, since the load U applied to the shaft portion 32*a* having received the sliding resistance Q1 concentrates on the second longitudinal side surface 32*c*6 only, the distribution of the load applied to the depression-protrusion portion 32*c*1 becomes non-uniform. As a result, the cylindricity and the total deflection of the shaft portion 32*a* deteriorate and the rotation of the developing roller 32 becomes unstable. Due to this, a blur appears in a developed toner image and it is not possible to obtain a satisfactory image.

In this manner, in the present embodiment, "crossing angle θ1"<"engagement angle F1". Due to this, the load U when the developing roller 32 receives the sliding resistance Q1 from the photosensitive drum 62 when the photosensitive drum 62 is rotating is distributed to both the first longitudinal side surface 32*c*5 and the second longitudinal side surface 32*c*6. Therefore, it is possible to suppress a deflection from occurring in the developing roller 32 when an image is formed on a sheet P.

In the present embodiment, the protrusion and the depression are continuously and alternately formed on one side and the other side from one end to the other end of the shaft portion 32*a* in the axial direction of the center of rotation of the shaft portion 32*a*. Since many protrusions and depressions are formed, the rigidity of the shaft portion 32*a* is improved further.

Although FIGS. 10A to 10C illustrate a configuration in which a depression-protrusion joint is also formed in a spindle portion at both ends of the shaft portion 32*a*, supported by the bearings 37L and 37R, a linear joint without any depression and protrusion may be formed in a spindle portion similarly to the charging roller of Embodiment 1.

Embodiment 3

Figures 17A, 17B:
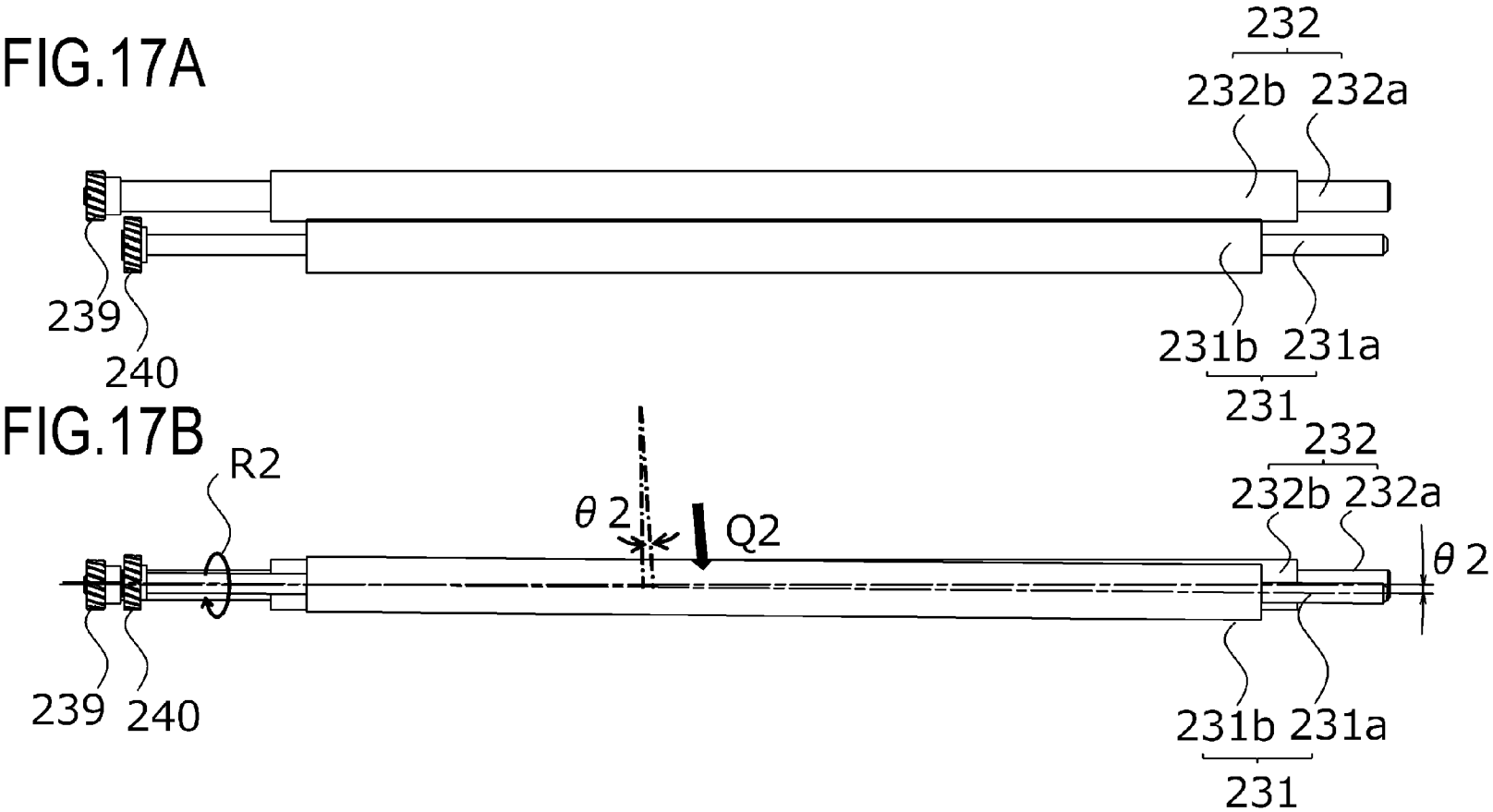
FIGS. 17A and 17B are external views illustrating a developing roller and a supply roller according to Embodiment 3 of the present invention.

Next, Embodiment 3 will be described with reference to FIGS. 17A and 17B. In the present embodiment, constituent elements similar to those of Embodiment 2 will be denoted by the same reference numerals as Embodiment 2 and the description thereof will be omitted. FIG. 17A is an external view illustrating a supply roller 231 and a developing roller 232 according to Embodiment 3. FIG. 17B is a bottom view of the supply roller 231 and the developing roller 232 when seen from an overlapping direction of the supply roller 231 and the developing roller 232.

As illustrated in FIG. 17A, the supply roller 231 includes a hollow shaft portion 231*a* formed of metal and a conductive elastic layer 231*b*, and portions other than both ends of the shaft portion 231*a* are coated by the elastic layer 231*b*. Moreover, the elastic layer 231*b* and the shaft portion 231*a* are bonded by an adhesive. On the other hand, the developing roller 232 includes a hollow shaft portion 232*a* formed of metal and a conductive elastic layer 232*b*. The elastic layer 232*b* of the developing roller 232 coats portions other than both ends of the shaft portion 232*a*. The elastic layer 232*b* and the shaft portion 232*a* are bonded by an adhesive. Moreover, the elastic layer 231*b* of the supply roller 231 is in contact with the elastic layer 232*b* of the developing roller 232 in order to supply a developer to the developing roller 232.

The shaft portion 231*a* of the supply roller 231 and the shaft portion 232*a* of the developing roller 232 are rotatably supported similarly to Embodiment 2. Moreover, a supply roller gear 240 and a developing roller gear 239 are fitted into one set of driving-side ends of the supply roller 231 and the developing roller 232, respectively, similarly to Embodiment 2. The supply roller gear 240 and the developing roller gear 239 engage with an input gear (not illustrated) and rotate with rotation of the input gear.

The shaft portion 231*a* of the supply roller 231 has a joint similar to that of the shaft portion 32*a* of the developing roller 32 according to Embodiment 2. Therefore, in a state in which engagement force is applied to the supply roller gear 240 via the input gear, the supply roller 231 rotates in the direction indicated by arrow R2 as illustrated in FIG. 17B. In this case, similarly to the developing roller 32 of Embodiment 2, since the shaft portion 231*a* of the supply roller 231 is also inclined, a crossing angle θ2 is formed between the axial line of the center of rotation of the supply roller 231 and the axial line of the center of rotation of the developing roller 232. Furthermore, the supply roller 231 receives sliding resistance Q2 from the developing roller 232 at the contact portion contacting the developing roller 232.

An engagement angle F2 (not illustrated) is provided in the joint of the shaft portion 231*a* of the supply roller 231 similarly to FIG. 10C so as to satisfy the relation of "crossing angle θ2"<"engagement angle F2 (not illustrated)". Due to this, as described in Embodiment 2, the load applied to the joint is distributed similarly to the shaft portion 32*a* of the developing roller 32. In this way, deterioration of the cylindricity and the total deflection of the shaft portion 231*a* is suppressed. As a result, it is possible to suppress non-uniform rotation of the supply roller 231 and to supply toner to the developing roller 232 accurately.

As described above, in the present embodiment, similarly to Embodiment 2, it is possible to suppress a deflection from occurring in the supply roller 231 when an image is formed on a sheet P.

Embodiment 4

Figure 18A:
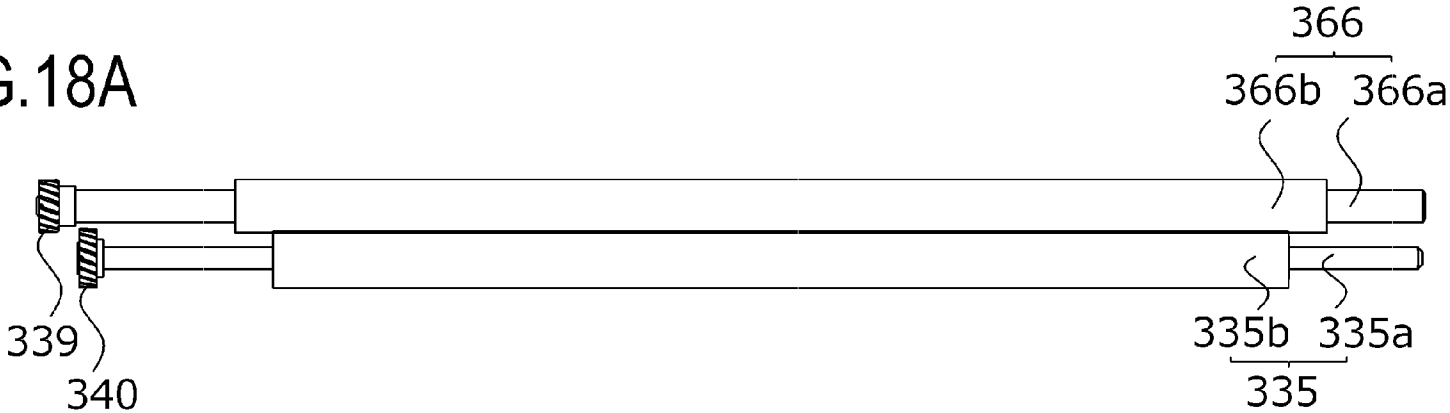
FIGS. 18A and 18B are external views illustrating a charging roller and a charging roller cleaning roller according to Embodiment 4 of the present invention.
Figure 18B:
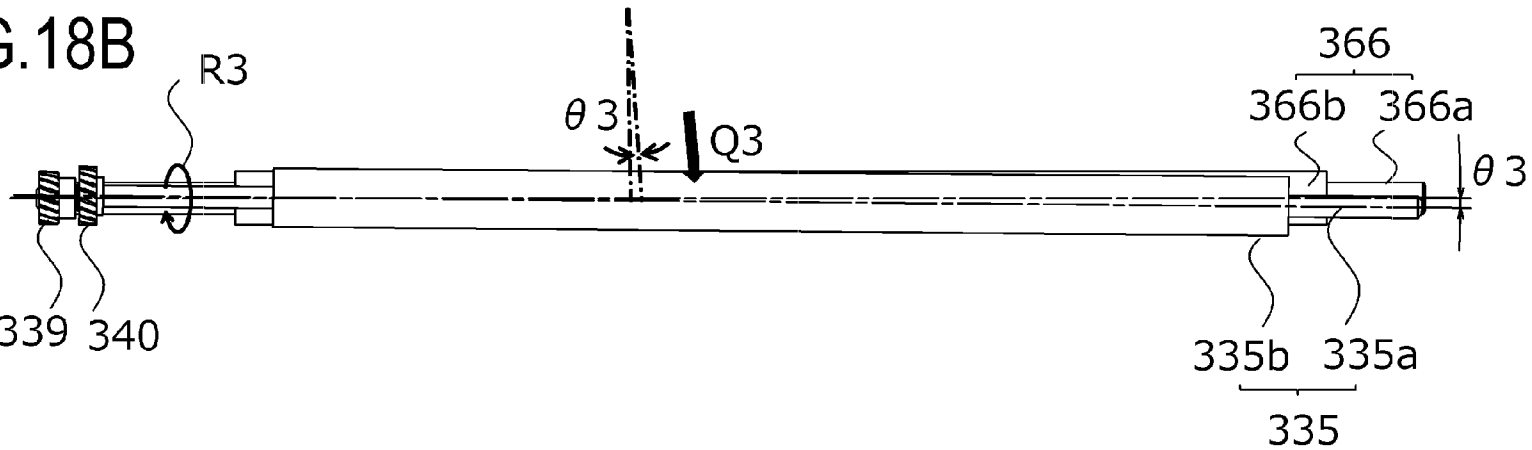

Next, Embodiment 4 will be described with reference to FIGS. 18A and 18B. In the present embodiment, constituent elements similar to those of Embodiment 2 will be denoted by the same reference numerals as Embodiment 2 and the description thereof will be omitted. FIG. 18A is an external view illustrating a charging roller cleaning roller 335 and a charging roller 366 according to Embodiment 4. FIG. 18B is a bottom view of the charging roller cleaning roller 335 and the charging roller 366 when seen from an overlapping direction of the charging roller cleaning roller 335 and the charging roller 366.

As illustrated in FIG. 18A, the charging roller cleaning roller 335 has a hollow shaft portion 335*a* formed of metal and a conductive elastic layer 335*b*. Moreover, portions other than both ends of the shaft portion 335*a* are coated with the elastic layer 335*b*, and the elastic layer 335*b* and the shaft portion 335*a* are bonded by an adhesive. The charging roller 366 includes a hollow shaft portion 366*a* formed of metal and a conductive elastic layer 366*b*. The elastic layer 366*b* of the charging roller 366 coats portions other than both ends of the shaft portion 366*a*. Moreover, the elastic layer 366*b* and the shaft portion 366*a* are bonded by an adhesive. The elastic layer 335*b* of the charging roller cleaning roller 335 is in contact with the elastic layer 366*b* of the charging roller 366 in order to clean paper dust and toner adhering to the charging roller 366.

The shaft portion 335*a* of the charging roller cleaning roller 335 and the shaft portion 366*a* of the charging roller 366 are rotatably supported similarly to Embodiment 2. A charging roller cleaning roller gear 340 and a charging roller gear 339 are fitted into one set of driving-side ends of the charging roller cleaning roller 335 and the charging roller 366, respectively, similarly to Embodiment 2. The charging roller cleaning roller gear 340 and the charging roller gear 339 engage with an input gear (not illustrated) and rotate with rotation of the input gear.

The shaft portion 335*a* of the charging roller cleaning roller 335 has a joint similar to that of the shaft portion 32*a* of the developing roller 32 according to Embodiment 2. Therefore, in a state in which engagement force is applied to the charging roller cleaning roller gear 340 via the input gear, the charging roller cleaning roller 335 rotates in the direction indicated by arrow R3 as illustrated in FIG. 18B. In this case, similarly to the developing roller 32 of Embodiment 2, since the shaft portion 335*a* of the charging roller cleaning roller 335 is also inclined, a crossing angle θ3 is formed between the axial line of the center of rotation of the charging roller cleaning roller 335 and the axial line of the center of rotation of the charging roller 366. The charging roller cleaning roller 335 receives sliding resistance Q3 from the charging roller 366 at the contact portion contacting the charging roller 366.

An engagement angle F3 (not illustrated) is provided in the joint of the shaft portion 335*a* of the charging roller cleaning roller 335 similarly to FIG. 10C so as to satisfy the relation of "crossing angle θ3"<"engagement angle F3 (not illustrated)". Due to this, similarly to the shaft portion 32*a* of the developing roller 32 according to Embodiment 2, since the load applied to the joint is distributed, deterioration of the cylindricity and the total deflection of the shaft portion 335*a* is suppressed. As a result, it is possible to suppress the charging roller cleaning roller 335 from rotating unstably and to obtain a satisfactory image.

As described above, in the present embodiment, similarly to Embodiment 2, it is possible to suppress a deflection from occurring in the charging roller cleaning roller 335 when an image is formed on a sheet P.

Embodiment 5

Figure 19A:
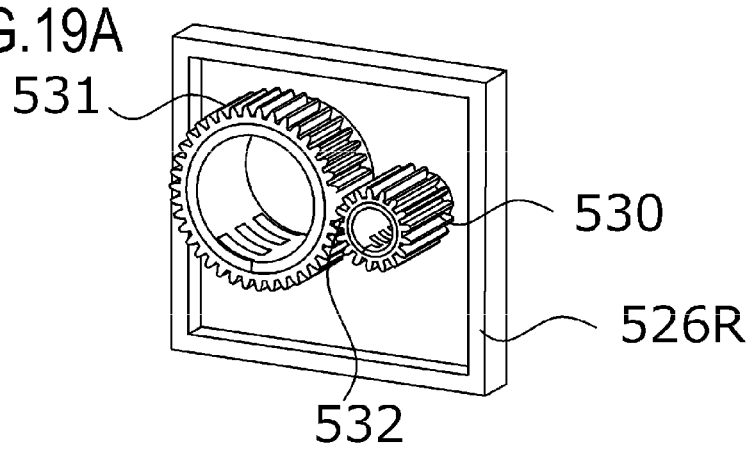
FIGS. 19A to 19C are perspective views illustrating a drive gear of a developing unit according to Embodiment 5 of the present invention.
Figure 19B:
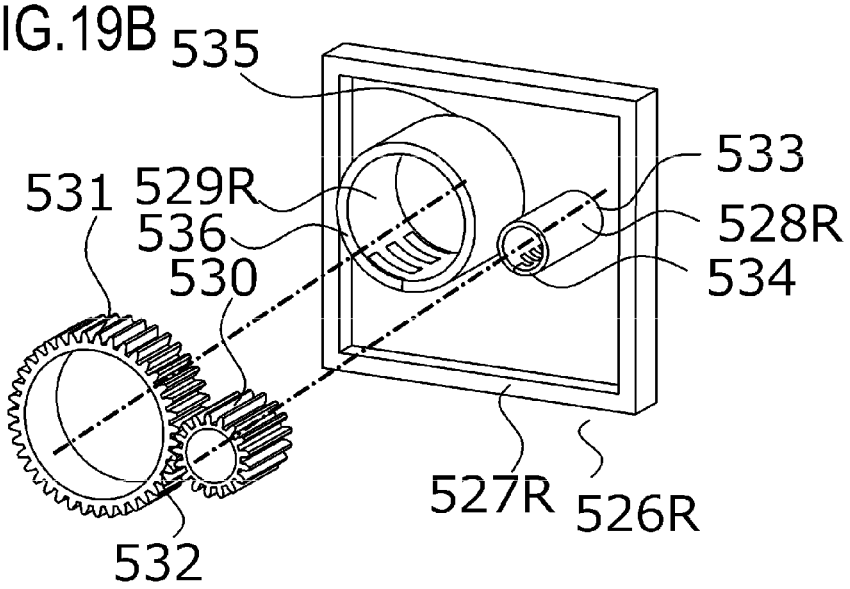
Figure 19C:
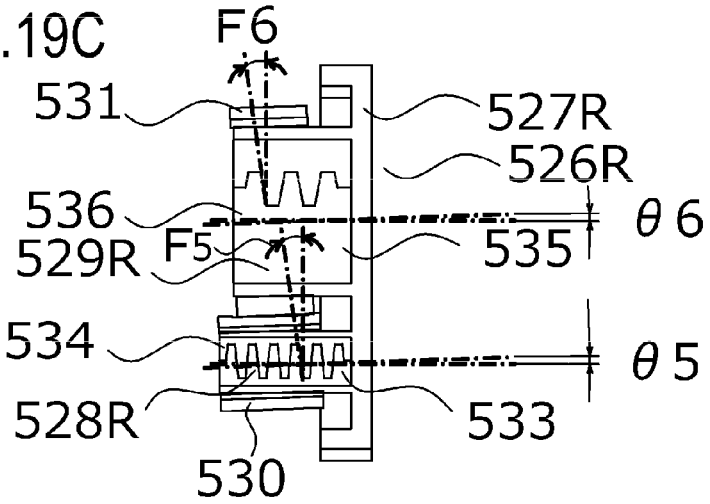

Next, Embodiment 5 will be described with reference to FIGS. 19A to 19C. In the present embodiment, constituent elements similar to those of Embodiment 2 will be denoted by the same reference numerals as Embodiment 2 and the description thereof will be omitted. FIG. 19A is a perspective view illustrating a drive gear of a developing unit according to Embodiment 5. FIG. 19B is an exploded perspective view illustrating a drive gear of the developing unit according to Embodiment 5. FIG. 19C is a schematic cross-sectional view of the drive gear of the developing unit according to Embodiment 5.

As illustrated in FIG. 19A, a first idler gear 530 and a second idler gear 531 are fitted into a second side member 526R of the developing unit of the present embodiment. The first idler gear 530 engages with the input gear 48 (see FIG. 12) and the first idler gear 530 rotates with rotation of the input gear 48. The first idler gear 530 engages with the second idler gear 531 at an idler gear engagement portion 532 and the rotation drive force is transmitted to the second idler gear 531 by rotation of the first idler gear 530. Moreover, the second idler gear 531 rotates a developer stirring gear (not illustrated) for rotating the transport member 43 (see FIG. 11).

As illustrated in FIG. 19B, the second side member 526R includes a resin portion 527R, a first idler spindle portion 528R, and a second idler spindle portion 529R. The first idler spindle portion 528R and the second idler spindle portion 529R are configured as a hollow metal core having a joint similar to that of the shaft portion 32*a* of the developing roller 32 according to Embodiment 2. A first idler spindle root portion 533 which is a root-side end of the first idler spindle portion 528R and a second idler spindle root portion 535 which is a root-side end of the second idler spindle portion 529R are supported in a cantilever manner in a state of being insert-molded to the resin portion 527R. A first idler spindle distal end 534 which is an end on a distal end side of the first idler spindle portion 528R supports the first idler gear 530. Similarly, a second idler spindle distal end 536 which is an end on a distal end side of the second idler spindle portion 529R supports the second idler gear 531.

Rotation drive force is applied from the input gear 48 (see FIG. 12) to the transport member 43 via the first and second idler gears 530 and 531 whereby the transport member 43 transports toner to the toner supply chamber 28 as illustrated in FIG. 11. In this case, the transport member 43 receives load torque associated with transport of toner and the toothed surfaces of the first and second idler gears 530 and 531 receive engagement force in the idler gear engagement portion 532.

By this engagement force, as illustrated in FIG. 19C, the first idler gear 530 is inclined by an angle θ5 (hereinafter referred to as a first idler crossing angle) with respect to the first idler spindle portion 528R. On the other hand, the second idler gear 531 is inclined by an angle θ6 (hereinafter referred to as a second idler crossing angle) with respect to the second idler spindle portion 529R. In this case, similarly to the developing roller 32 according to Embodiment 2, the first idler gear 530 is inclined with respect to the first idler spindle portion 528R, and the second idler gear 531 is inclined with respect to the second idler spindle portion 529R. Since the first idler gear 530 is inclined, the first idler crossing angle θ5 is formed between the first idler gear 530 and the first idler spindle portion 528R. Similarly, since the second idler gear 531 is inclined, the second idler crossing angle θ6 is formed between the second idler gear 531 and the second idler spindle portion 529R. In this way, the first idler spindle portion 528R receives bearing load from the first idler gear 530, and similarly, the second idler spindle portion 529R receives bearing load from the second idler gear 531.

Here, in the present embodiment, a first idler engagement angle F5 (not illustrated) is provided in the joint of the first idler spindle portion 528R similarly to FIG. 10C and is configured to satisfy the relation of "first idler crossing angle θ5"<"first idler engagement angle F5 (not illustrated)". Similarly, a second idler engagement angle F6 is provided in the joint of the second idler spindle portion 529R similarly to FIG. 10C and is configured to satisfy the relation of "second idler crossing angle θ6"<"second idler engagement angle F6".

Due to this, since the load applied to the joint is distributed similarly to the shaft portion 32*a* of the developing roller 32 according to Embodiment 2, deterioration of the cylindricity and the total deflection of the first and second idler spindle portions 528R and 529R is suppressed. As a result, it is possible to stabilize the rotation of the first and second idler gears 530 and 531 and to stabilize the rotation of the transport member 43. In this way, the transport member 43 can stir and transport toner accurately.

In the present embodiment, the root portion (see the first and second idler spindle root portions 533 and 535 in FIGS. 19A to 19C) of the hollow metal shaft is supported on the bearing member in a cantilever manner. However, the configuration of the hollow metal shaft is not necessarily limited to this. The distal end (see the first and second idler spindle distal ends 534 and 536 in FIGS. 19A to 19C) of the hollow metal shaft may be supported by the bearing member 37R, the developing frame 23, and the like so that both sides are supported.

As described above, in the present embodiment, similarly to Embodiment 2, it is possible to suppress a deflection from occurring in the first and second idler spindle portions 528R and 529R when an image is formed on a sheet P.

In the respective embodiments, the joint 32*c* may not extend in the axial direction of the center of rotation of the shaft portion 32*a*. For example, the extension direction of the joint 32*c* may be inclined with respect to the axial direction of the center of rotation of the shaft portion 32*a*.

In the respective embodiments, the shape of the depression and the protrusion of the joint 32*c* may not be formed of three sides including a pair of side surface portions that are not parallel to the axial direction and a bottom portion or a distal end that is parallel to the axial direction. For example, The depression and the protrusion of the joint 32*c* may have a shape that is depressed or protrudes in a triangular shape formed of approximately two sides of the pair of side surface portions only and may be configured as depressions and protrusions having a non-linear shape (for example, a semi-circular shape). That is, as described above, the shape of the depressions and protrusions is not particularly limited as long as it is possible to form the joint 32*c* capable of distributing load generated in engaging depression-protrusion portions to the entire engagement portions to suppress local concentration of load.

In the respective embodiments, the protrusions and the depressions of the joint 32*c* may not be provided continuously from one end to the other end of the shaft portion 32*a*. For example, the protrusion and the depression may not be formed in a portion in the axial direction of the shaft portion 32*a*.

The constituent elements of the respective embodiments may be combined with each other as long as the combination is possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2016-127903, filed on Jun. 28, 2016 and No. 2016-127959, filed on Jun. 28, 2016 which are hereby incorporated by reference herein in their entirety.

What is claimed is:

1. A roller used in an image forming apparatus, comprising:

a cylindrical shaft having a joint that is formed by a pair of ends of the cylindrical shaft, the pair of ends face or make contact with each other in a circumferential direction; and a cylindrical coating layer that coats an outer circumference of the cylindrical shaft, the joint having a depression-protrusion-shaped portion, the joint being formed so as to extend from one end to the other end of the cylindrical shaft in an axial direction of the cylindrical shaft, and the roller making contact with a rotating member provided in an apparatus main body of the image forming apparatus or a cartridge that is detachable from the apparatus main body so that an axial line of the roller is not parallel to an axial line of the rotating member, wherein the cylindrical shaft has facing surfaces which form the depression-protrusion-shaped portion of the joint and which face or make contact with each other, and moreover which extend in a direction non-parallel to the axial direction, and the facing surfaces are inclined at a predetermined engagement angle with respect to a circumferential direction, and a generating line of a circumferential surface of the coating layer and a generating line of a circumferential surface of the rotating member cross each other at a crossing angle smaller than the engagement angle.

2. The roller according to claim 1, wherein the crossing angle is equal to or smaller than 2.5°.

3. The roller according to claim 1, wherein a protrusion and a depression that form the depression-protrusion-shaped portion include respectively a parallel portion that is parallel to the axial direction and a non-parallel portion that is not parallel to the axial direction, and the facing surface is a facing surface where the non-parallel portion of a protrusion of one of corresponding ends and the non-parallel portion of a depression of the other end face each other.

4. The roller according to claim 1, wherein a width in the axial direction of the protrusion narrows gradually toward a distal end in the circumferential direction, and a width in the axial direction of the depression narrows gradually toward a bottom in the circumferential direction.

5. The roller according to claim 1, wherein the cylindrical shaft is metal.

6. The roller according to claim 1, wherein the cylindrical shaft is a press-molded body.

7. The roller according to claim 1, wherein the coating layer is an elastic member.

8. The roller according to claim 1, wherein the rotating member is a photosensitive drum, and the roller is a charging roller for charging the photosensitive drum.

9. The roller according to claim 1, wherein the rotating member is a photosensitive drum, and the roller is a developing roller for bearing a developer to develop an electrostatic latent image formed on the photosensitive drum.

10. The roller according to claim 1, wherein the rotating member is a developing roller for bearing a developer, and the roller is a supply roller that supplies the developer to the developing roller.

11. The roller according to claim 1, wherein the rotating member is a charging roller for charging a photosensitive drum, and the roller is a cleaning roller for cleaning the charging roller.

12. A rotating member unit used in an image forming apparatus and including a first rotating member and a second rotating member that rotate while making contact with each other, wherein the first rotating member includes a cylindrical shaft having a joint that is formed by a pair of ends of the cylindrical shaft, the pair of ends face or make contact with each other in a circumferential direction, the joint has a depression-protrusion-shaped portion and is formed so as to extend from one end to the other end of the cylindrical shaft in an axial direction of the cylindrical shaft, the first and second rotating members make contact with each other so that rotation axes thereof are not parallel to each other, the cylindrical shaft has facing surfaces which form the depression-protrusion-shaped portion of the joint and which face or make contact with each other and moreover which extend in a direction non-parallel to the axial direction, and the facing surfaces are inclined at a second angle with respect to the circumferential direction, the second angle being larger than a first angle which is an angle at which generating lines of circumferential surfaces of the first and second rotating members cross each other.

13. The rotating member unit according to claim 12, wherein a protrusion and a depression that form the depression-protrusion-shaped portion include respectively a parallel portion that is parallel to the axial direction and a non-parallel portion that is not parallel to the axial direction, and the facing surface is a facing surface where the non-parallel portion of a protrusion of one of corresponding ends and the non-parallel portion of a depression of the other end face each other.

14. The rotating member unit according to claim 12, wherein a width in the axial direction of the protrusion narrows gradually toward a distal end in the circumferential direction, and a width in the axial direction of the depression narrows gradually toward a bottom in the circumferential direction.

15. The rotating member unit according to claim 12, wherein the cylindrical shaft is metal.

16. The rotating member unit according to claim 12, wherein the cylindrical shaft is a press-molded body.

17. The rotating member unit according to claim 12, wherein the first rotating member has a cylindrical coating layer that coats the outer circumference of the cylindrical shaft, and the coating layer is an elastic member.

18. The rotating member unit according to claim 12, wherein the second rotating member is a photosensitive drum, and the first rotating member is a charging roller for charging the photosensitive drum.

19. The rotating member unit according to claim 12, wherein the second rotating member is a photosensitive drum, and the first rotating member is a developing roller for bearing a developer for developing an electrostatic latent image formed on the photosensitive drum.

20. The rotating member unit according to claim 12, wherein the second rotating member is a developing roller that bears a developer, and the first rotating member is a supply roller that supplies a developer to the developing roller.

21. The rotating member unit according to claim 12, wherein the second rotating member is a charging roller for charging a photosensitive drum, and the first rotating member is a cleaning roller for cleaning the charging roller.

22. A cartridge configured to be detachable from an apparatus main body of an image forming apparatus, comprising the roller according to claim 1.

23. A cartridge configured to be detachable from an apparatus main body of an image forming apparatus, comprising the rotating member unit according to claim 12.

24. An image forming apparatus comprising the roller according to claim 1.

25. An image forming apparatus comprising the rotating member unit according to claim 12.

* * * * *